US010647396B2

(12) United States Patent
Marjan et al.

(10) Patent No.: US 10,647,396 B2
(45) **Date of Patent: *May 12, 2020**

(54) PADDLEBOARD KIT

(71) Applicants: Marjaneh Marjan, San Clemente, CA (US); Manouchehr Marjan, Irvine, CA (US)

(72) Inventors: Marjaneh Marjan, San Clemente, CA (US); Manouchehr Marjan, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/423,711

(22) Filed: May 28, 2019

(65) Prior Publication Data

US 2019/0308708 A1 Oct. 10, 2019

Related U.S. Application Data

(63) Continuation-in-part of application No. 16/238,221, filed on Jan. 2, 2019, which is a continuation of application No. 15/945,674, filed on Apr. 4, 2018, now Pat. No. 10,207,783.

(51) Int. Cl.

| | |
|---|---|
| ***B63H 16/04*** | (2006.01) |
| ***B63B 35/79*** | (2006.01) |
| ***B63H 16/06*** | (2006.01) |
| ***B63B 35/85*** | (2006.01) |

(52) U.S. Cl.

CPC ..... *B63H 16/04* (2013.01); *B63B 35/79* (2013.01); *B63B 35/85* (2013.01); *B63H 16/06* (2013.01)

(58) Field of Classification Search

CPC ..... B63B 35/79; B63B 35/85

See application file for complete search history.

(56) References Cited

U.S. PATENT DOCUMENTS

| | | | | |
|---|---|---|---|---|
| 1,640,390 | A | 8/1927 | Bacon | |
| 3,180,306 | A | 4/1965 | Gouedy | |
| 3,377,977 | A * | 4/1968 | Malm | B63B 35/7933 440/13 |
| 3,779,202 | A | 12/1973 | Martin | |
| 3,845,733 | A | 11/1974 | Jackman | |
| 3,970,031 | A | 7/1976 | Vrana | |
| 1,698,033 | A | 10/1987 | Hall | |
| 4,805,546 | A | 2/1989 | Geller | |

(Continued)

FOREIGN PATENT DOCUMENTS

| | | |
|---|---|---|
| BE | 896391 | 8/1983 |
| GB | 2178387 | 2/1987 |

*Primary Examiner* — S. Joseph Morano
*Assistant Examiner* — Jovon E Hayes
(74) *Attorney, Agent, or Firm* — Jafari Law Group, Inc.

(57) ABSTRACT

The invention involves a paddleboard kit for converting any water sports board such as a surfboard into a paddleboard. An oar support assembly, typically secures oars with pivotal paddles to the board; facilitating rowing exercises that may be practiced while kneeling or standing. During use, the pivotable paddles pivot in such a way that the blade portion holds a steady position in relation to a shaft portion on the power stroke, whilst being free to fold in the opposite sense on the idle stroke when each stroke is executed as a substantially axial thrust of the shaft. The oar support assembly secures the pair of oars and is itself secured to the board by way of board couplers adjustably coupled to a portion of a strap that tightens to snuggly wrap around the board.

20 Claims, 16 Drawing Sheets

(56) References Cited

U.S. PATENT DOCUMENTS

| | | | | |
|---|---|---|---|---|
| 5,041,037 | A | 8/1991 | Jaw | |
| 6,764,363 | B2 | 7/2004 | Rosen | |
| 6,890,226 | B2 * | 5/2005 | Wang | B63B 35/79 440/101 |
| 7,267,586 | B1 | 9/2007 | Murphy | |
| 8,342,896 | B1 | 1/2013 | Sardar | |
| 9,067,652 | B2 | 6/2015 | Nanayakkara | |
| 9,533,741 | B2 * | 1/2017 | Parkinson | B63H 16/105 |
| 9,682,748 | B2 * | 6/2017 | Cesario | B63B 35/85 |
| 10,017,233 | B2 * | 7/2018 | Ajello | B63B 35/7943 |
| 10,207,783 | B1 * | 2/2019 | Marjan | B63H 16/06 |

* cited by examiner

PADDLEBOARD KIT

PRIORITY AND CROSS-REFERENCE TO RELATED APPLICATIONS

The present application is a continuation-in-part of pending U.S. patent application Ser. No. 16/238,221, filed on Jan. 2, 2019, which is a continuation of U.S. patent application Ser. No. 15/945,674, filed on Apr. 4, 2018, now patented, their disclosure incorporated herein by reference in their entirety.

TECHNICAL FIELD OF THE INVENTION

The present invention relates generally to paddleboards, and more specifically, to a kit for converting a board into a stand-up paddle board with secured oars.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

With the ever-increasing popularity of staying fit, consumers are continuously searching for devices that are designed for outdoor use, but which facilitate exercises commonly practiced in an indoor gym. One popular exercise machine is the rowing machine, which exercises the arms as well as the back and legs; generally providing for a full workout. Although an active individual may use a canoe, a rowboat or a stand-up paddleboard to achieve similar exercises outdoors, it is undesirable for enthusiasts to have to pick one particular device for a particular outing.

For example, it would be desirable for a user to take a single device to a lake or the beach and use it in a variety of ways rather than having to own several types of sporting equipment. Specifically, with regards to water sports boards, enthusiast or even amateurs new to boarding sports often own several types of boards. As such, it would be desirable to provide a kit that may convert or retrofit one type of device into another type of device, without much effort thereby obviating the need for the user to purchase two types of devices.

Currently, the prior art is riddled with outdoor devices including different types of aquatic devices, rowing devices such as rowing surfboards, vessels with retractable board fins and unique looking water craft propelled by varying means. The problem with the prior art persists because each of these devices is generally highly specialized and as such can only be used for their intended purpose, and their use is limited to their intended functionality.

One example of these highly specialized devices is disclosed in U.S. Pat. No. 9,533,741 to Parkinson et al. That disclosure provides for a stand-up paddle board with left and right oars attached to left and right transmissions respectively mounted in the hull of the paddle board. The hull of the paddle board also includes a bow, stern and foot pads upon which the operator stands on. The oars pivot around an oar pivot in a longitudinal direction and paddle arms attached to the oars pivot around an arm pivot in a longitudinal direction. The paddle arms terminate in at a lower at a paddle so that when the operator urges the oars in a rearward and forward motion, the paddle arms pivot around an arm pivot and propel the paddle board. One problem with this device, and other like it, is that the oars are fixed within channels of the board such that their movement is highly restricted. Not only does this limit the range of motion that is commonly preferred for rowing exercises, but also limits the uses for the device. That is, another problem, as with other prior art devices, is that a user would have to select between this device and another device while out at the beach or a lake. Thus, it would be desirable to provide for a kit that could transform an ordinary water sports board to a rowing board such as a paddle board, with enough easy such that a user could take a single device to an outing and quickly retrofit a water sports board into a paddleboard and vice-versa with minimal effort.

Therefore, there exists a previously unappreciated need for a new and improved paddleboard kit that facilitates the functionalities mentioned above and addresses the shortcomings of the prior art. It is to these ends that the present invention has been developed.

SUMMARY OF THE INVENTION

To minimize the limitations in the prior art, and to minimize other limitations that will be apparent upon reading and understanding the present specification, the present disclosure describes a paddleboard kit.

Generally, the invention involves a paddleboard kit, or a kit for converting any water sports board such as a surfboard, long board or paddleboard, into a paddleboard including a plurality of oars secured thereto. In exemplary embodiments, the kit includes an oar support assembly that secures a pair of oars to the water sports board, facilitating a plurality of rowing exercises that a user may practice while kneeling or standing up on the board. While in use, each of the pair of oars is secured to the body of the board and is not generally lifted or removed completely from the water. As such, each of the pair of oars include pivotable paddles that pivot in such a way that the blade portion holds a steady position in relation to a shaft portion on the power stroke whilst being free to fold in the opposite sense on the idle stroke. The oar support assembly securely receives the pair of oars and is itself secured to the board by way of a pair of board couplers adjustably coupled to a portion of a strap that tightens to securely and snuggly wrap around the body of the board. Each of the pair of board couplers include a board support member configured to register with a top surface and an edge of the board. Each of the pair of board couplers further include an oar receiving member that allows an oar to rotate at least in a forward and backward direction as well as in a side to side direction. In this manner, each of the oars with pivotable paddles may be secured to the board but yet provide a full range of motion required for executing the rowing exercises that naturally propel the board.

A paddleboard kit, in accordance with some embodiments of the present invention, comprises: a pair of oars with pivotable paddles; and an ore support assembly including a pair of board couplers coupled to a strap for securing the ore support assembly and the pair of oars to a water sports board, each of the pair of board couplers comprising: a board support member having a bracket comprising perpendicular planar supports including a horizontal planar support adapted to register with a top surface of the water sports board, and a vertical planar support adapted to register with an edge of the water sports board; and an ore receiving member swivably coupled to the bracket and configured to receive one of the pair of oars with pivotable paddles.

A paddleboard kit, in accordance with some embodiments of the present invention, comprises: a pair of oar arms; and an ore support assembly including a pair of board couplers coupled to a strap for securing the ore support assembly and the pair of oar arms to a water sports board, each of the pair of board couplers comprising: a board support member having a bracket comprising perpendicular planar supports including a horizontal planar support adapted to register with a top surface of the water sports board, a vertical planar support adapted to register with an edge of the water sports board, and strap attachment slots on each of the perpendicular planar supports for receiving a portion of the strap therethrough; and an ore receiving member swivably coupled to the bracket and configured to receive one of the pair of oar arms. In such embodiments, detachable paddles may be included separately.

In some embodiments, the paddles may include pivotable paddles detachable from the oar arms, each of the pair of pivotable paddles comprising: a paddle support coupled to a shaft, the paddle support having a paddle stop perpendicular to the shaft; a hinge coupled to the paddle support along a length of the shaft; and a paddle body comprising paddles swivably connected by the hinge, such that the paddles have a range of motion about the hinge limited by the paddle stop paddle stop.

In some embodiments, the paddles may include pivotable paddles detachable from the oar arms, each of the pair of pivotable paddles comprising: a paddle support coupled to a shaft, the paddle support having a paddle stop parallel to the shaft; and a paddle body pivotably coupled to the paddle support with a rod perpendicular to the shaft traversing the paddle support and the paddle body, such that the paddle body has a range of motion about the rod that is limited by the paddle stop.

A paddleboard kit, in accordance with some embodiments of the present invention, comprises: a pair of oars with pivotable paddles; and an oar support assembly including a pair of board couplers coupled to a strap for securing the oar support assembly and the pair of oars with pivotable paddles to a water sports board, each of the pair of board couplers comprising: a board support member configured to register with a top surface and an edge of the water sports board; and an oar receiving member including a base coupled to the board support member and an oar retaining arm configured to receive an oar of the pair of oars with pivotable paddles and move the oar longitudinally and laterally with respect to a length of the water sports board.

A paddleboard kit, in accordance with some embodiments of the present invention, comprises: a pair of oars with pivotable paddles; and an oar support assembly including a pair of board couplers coupled to a strap for securing the oar support assembly and the pair of oars to a water sports board, each of the pair of board couplers comprising: a board support member, including an L-shaped bracket configured to register with a top surface and an edge of the water sports board; and an oar receiving member, including: a spherical housing coupled to an oar retaining arm comprising an aperture for receiving a portion of an oar, wherein: the spherical housing is defined by a first semispherical component and a second spherical component housing a ball within a spherical cavity defined by an interior of each of the first and second semispherical components; and the ball is sized slightly smaller than the cavity such that ball is free to rotate within the spherical cavity.

A paddleboard kit, in accordance with some embodiments of the present invention, comprises: a pair of oars with pivotable paddles; and an oar support assembly including a pair of board couplers adjustably coupled to a portion of a strap for securing the oar support assembly and the pair of oars to a water sports board, each of the pair of board couplers comprising: a board support member configured to register with a top surface and an edge of the water sports board; and an oar receiving member coupled to the board support member, wherein: the oar receiving member includes a spherical housing coupled to a retaining arm having a tubular body; and the spherical housing encloses a ball exposed partially via an aperture configured to receive the oar retaining arm such that the ball rotates the retaining arm to move longitudinally and laterally with respect to a length of the water sports board.

A paddleboard kit, in accordance with some embodiments of the present invention, comprises: a pair of oars with pivotable paddles; and an oar support assembly including a pair of board couplers coupled to a strap for securing the oar support assembly and the pair of oars to a water sports board, each of the pair of board couplers comprising: a board support member configured to register with a top surface and an edge of the water sports board; and an oar receiving member including an aperture configured to receive one of the pair of oars, the oar receiving member rotatably coupled to the board support member such that the board support member rotates the oar receiving member about a longitudinal axis of the board support member, and the oar receiving member further rotates about an axis that is perpendicular to the longitudinal axis of the board support member.

A paddleboard kit, in accordance with other embodiments of the present invention, comprises: a pair of oars with pivotable paddles; and an oar support assembly including a pair of board couplers coupled to a strap for securing the oar support assembly and the pair of oars to a water sports board, each of the pair of board couplers comprising: a board support member, including an L-shaped bracket configured to register with a top surface and an edge of the water sports board, and a tubular body swivably secured to a fork end of the L-shaped bracket with a rod that traverses the tubular body and the fork end, the tubular body including a perpendicular member; and a rotatable frame including an aperture configured to receive one of the pair of oars, the rotatable frame rotatably coupled to the perpendicular member such that the rotatable frame rotates about an axis of the perpendicular member, wherein the board support member rotates the rotatable frame about a longitudinal axis of the tubular body that is perpendicular to the axis of the perpendicular member.

A paddleboard kit, in accordance with yet other embodiments of the present invention, comprises: a pair of oars with pivotable paddles; and an oar support assembly including a pair of board couplers adjustably coupled to a portion of a strap for securing the oar support assembly and the pair of oars to a water sports board, each of the pair of board couplers comprising: a board support member configured to register with a top surface and an edge of the water sports board, the board support member swivable about a longitudinal axis of a tubular body of the board support member; and an oar receiving member rotatably coupled to the tubular body of the board support member, wherein: the board support member rotates the oar receiving member about the longitudinal axis of the tubular body, and the oar receiving member further rotates about an axis that is perpendicular to the longitudinal axis of the tubular body of the board support member.

A method for retrofitting a water sports board to a paddleboard in accordance with practice of the present invention comprises: coupling a first board coupler of an oar support assembly to the water sports board; coupling a second board coupler of the oar support assembly to the water sports board; tightening a strap adjustably coupled between the first board coupler and the second board coupler of the oar support assembly such that the water sports board is snuggly secured therein between the first board coupler and the second board coupler; inserting a first oar including a first pivotable paddle through the first board coupler; and inserting a second oar including a second pivotable paddle through the second board coupler.

It is an objective of the present invention to provide a kit suitable for retrofitting a water sports board, such as a surfboard, into a paddleboard.

It is another objective of the present invention to provide a paddle board with oars that facilitate commonly practiced rowing exercises.

It is yet another objective of the present invention to provide a kit that may be easily applied to a water sports board and easily removed from a water sports board, with little or no hassle.

It is yet another objective of the present invention to provide a kit that may be used with a variety of water sports boards so that the kit's use is relatively universal.

It is yet another objective of the present invention to provide a paddleboard kit and methods of putting together the same.

These and other advantages and features of the present invention are not meant as limiting objectives, but are described herein with specificity so as to make the present invention understandable to one of ordinary skill in the art.

BRIEF DESCRIPTION OF THE DRAWINGS

The paddleboard kit and methods of putting together the same as disclosed herein are further described in terms of exemplary embodiments. These exemplary embodiments are described in detail with reference to the drawings, which have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention. These embodiments are non-limiting exemplary embodiments, in which like reference numerals represent similar structures throughout the several views of the drawings. The drawings that accompany the detailed description can be briefly described as follows.

DETAILED DESCRIPTION OF THE INVENTION

Figure 1:
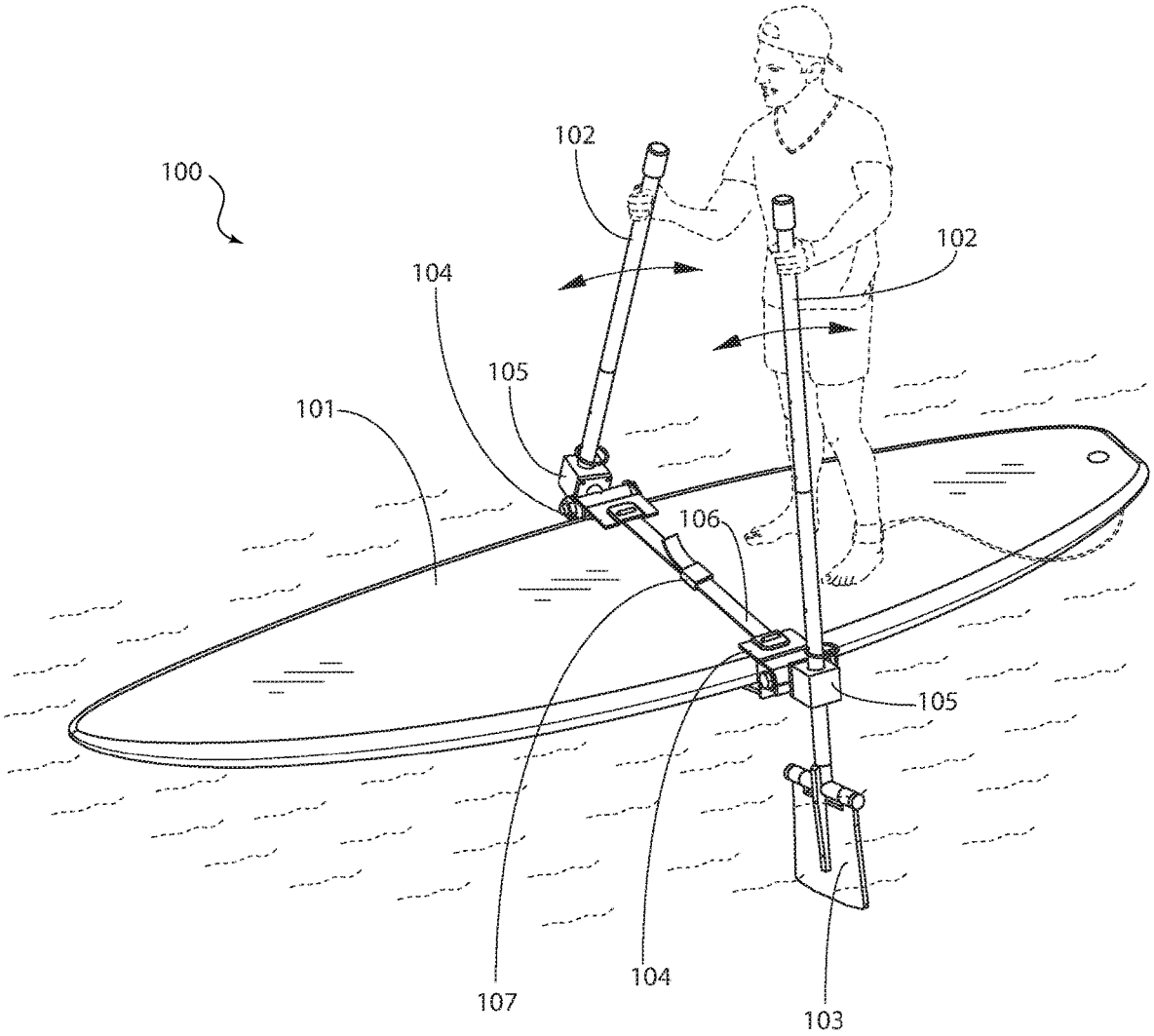
FIG. 1 illustrates a perspective view of a water sports board that has been retrofitted with a kit in accordance with the present invention suitable for stand-up paddleboarding.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made without departing from the scope of the invention. Wherever possible, the same reference numbers are used in the drawings and the following description to refer to the same or similar elements.

In the following detailed description, numerous specific details are set forth by way of examples in order to provide a thorough understanding of the relevant teachings. However, it should be apparent to those skilled in the art that the present teachings may be practiced without such details. In other instances, well known structures, components and/or functional or structural relationship thereof, etc., have been described at a relatively high-level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy. Similarly, terms, such as "a, an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

In the following description, a water sports board or simply board, may refer to a surfboard, a long board, a short board, a prone board, a paddle board or any other elongated platform used in water sports such as surfing, paddleboarding, stand up paddle surfing, or stand up paddleboarding, which may be practiced in the open ocean, lakes, or other bodies of water. The present disclosure relates to, among other things, paddleboard kits and methods of putting together the same.

Turning now to the figures, FIG. 1 illustrates a perspective view of a water sports board that has been retrofitted with a kit in accordance with the present invention, so that the board is converted from a regular board into a board suitable for stand-up or kneeling paddleboarding. More specifically, FIG. 1 depicts all components of a kit 100, which have been put together with board 101 in order to retrofit board 101 to a stand-up or kneeling paddleboard suitable for stand-up or kneeling exercises. The components of kit 100 include oars 102, each including pivotable paddles 103, and both secured to the board 101 via an oar support assembly that includes board couplers (i.e. each coupler comprising board support members 104 and rotatable oar receiving members 105). The board couplers of the oar support assembly are secured in place against a body of board 101 via a securing means such as a belt or strap 106 that snuggly wraps around the body of the board in-between each of the board couplers, and more specifically between board support members 104. In exemplary embodiments, strap 106 may be adjustable via a clasp or fastener 107.

As may be appreciated from FIG. 1, a board in accordance with the present invention may be a long board or a typical paddle board, in which case a user may practice rowing exercises in a standing configuration. However, and without limiting the scope of the present invention, a user may use kit 100 on a smaller or shorter board and implement kneeling rowing exercises as well. As such, a variety of board sizes and shapes may be implemented with kit 100, without deviating from the scope of the present invention. Notably, if the user wants to use the board as a surfboard, the user need only unbuckle or otherwise unfasten fastener 107 to remove strap 106 thus removing the oar support assembly to utilize the surfboard as typically intended (i.e. without oars). Wanting to exercise with the oars again, the user need only strap the oar support assembly back onto the board as will be discussed further below with reference to other figures such as FIG. 6. In some embodiments, kit 100 is provided to consumers without the board. In other exemplary embodiments, kit 100 may comprise the water sports board enclosed in a package with the other components of the kit.

Figure 2A:
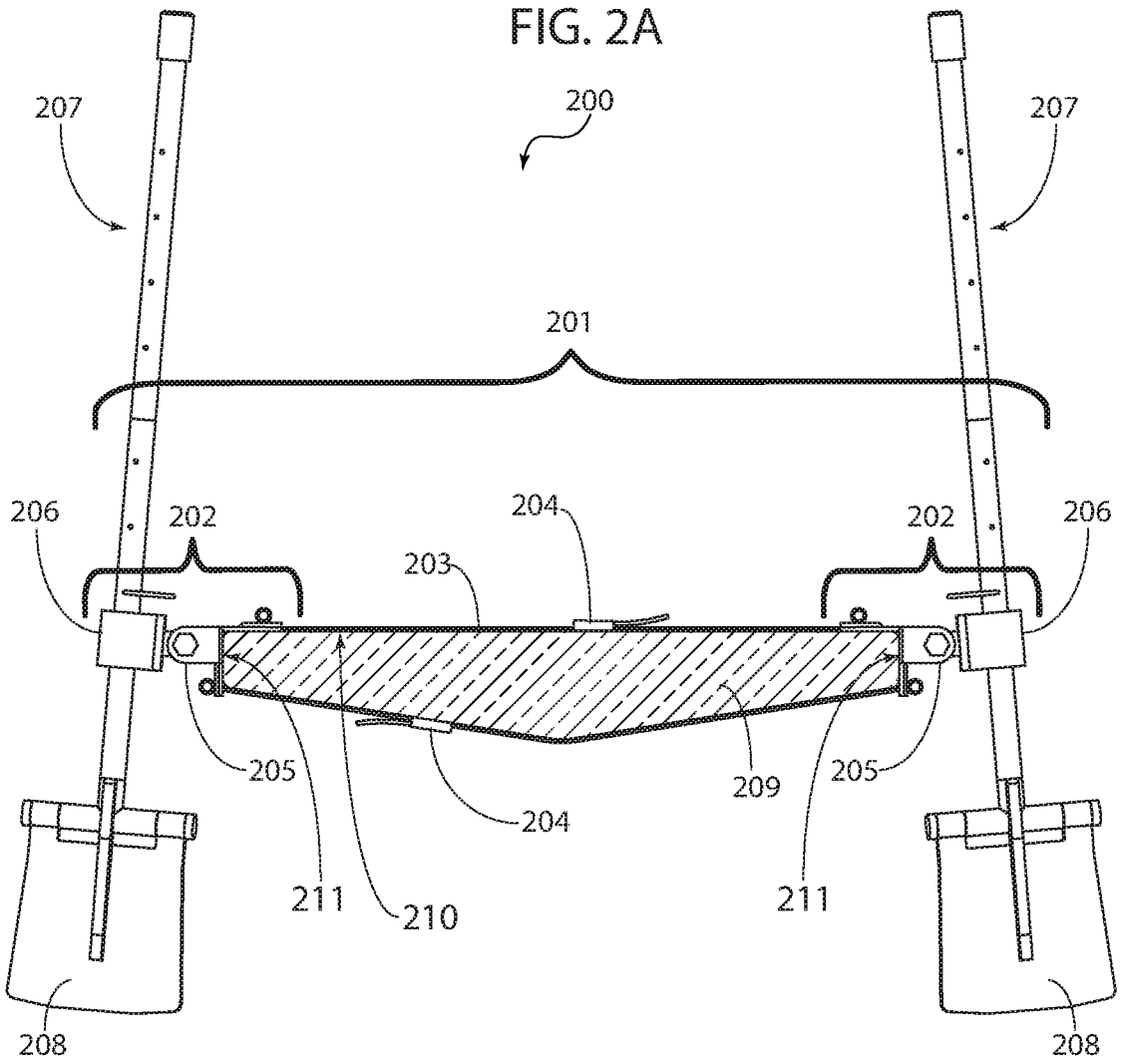
FIG. 2A illustrates a cross-sectional front view of a paddleboard retrofitted with a kit in accordance with the present invention.

Turning now to the next figure, FIG. 2A illustrates a cross-sectional front view of a paddleboard retrofitted with a kit in accordance with the present invention. More specifically, FIG. 2A depicts kit 200, which includes oar support assembly 201 for securing oars 207 to board 209, in accordance with the present invention, in a manner such that a desired range of movement is provided for each oar 207, and so that the oars 207 and oar support assembly 201 may be easily removed and board 209 used as it may be originally intended.

In this exemplary embodiment, oar assembly 201 comprises a pair of board couplers 202, each including a board support member 205 configured to register with a top surface 210 and an edge 211 of board 209. Moreover, each board support member 205 is coupled to an oar receiving member 206, each including apertures on a support frame configured to receive one of the pair of oars 207. The oar receiving members 206 are each rotatably coupled to the board support members 205 such that the board support member 205 rotates the oar receiving member 206 about a longitudinal axis of the board support member 205. Further, in some exemplary embodiments, each oar receiving member 206 also rotates about an axis that is perpendicular to the longitudinal axis of the board support member 205; in this way, the user may swivel or rotate each oar laterally (by for example moving each board support member 205 from left to right or side to side with respect to a length of the board) and swivel or rotate each oar longitudinally (by for example moving each oar receiving member 206 forwards and backwards with respect to the length of the board).

In exemplary embodiments, to secure each board coupler (and thus oar support assembly 201) to the board, a belt or strap 203 may be coupled or fastened in-between. Preferably, although not necessarily, the strap may be adjustable with one or more fasteners 204. In some embodiments, floating devices 212 may be optionally implemented below board 209, by for example—and without limiting the scope of the present invention—attaching the floating devices along a bottom length of the board 209, and or securing each floating device 212 with the help of strap 203 (see for example FIG. 2B).

Figure 2B:
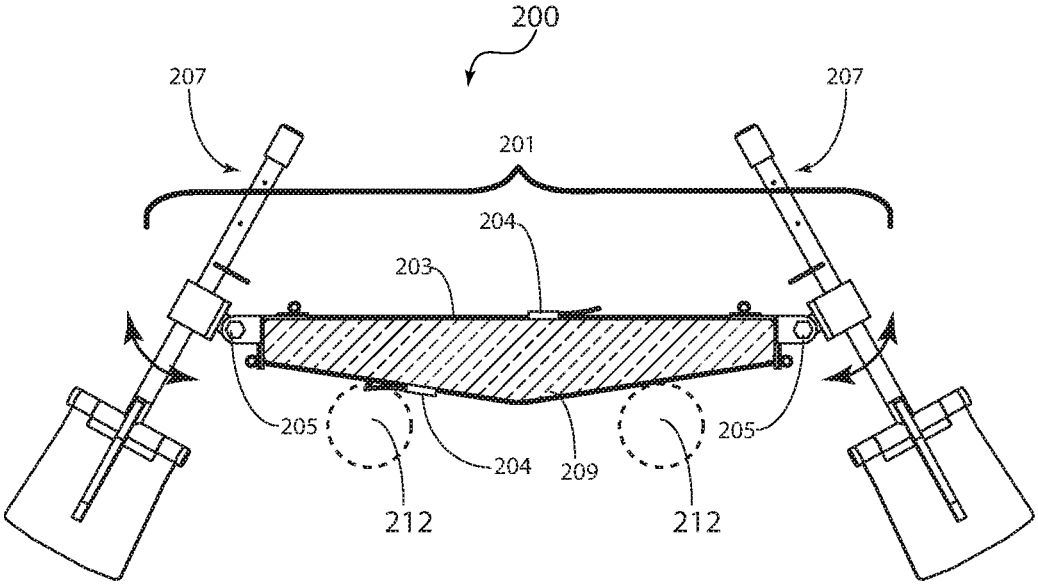
FIG. 2B illustrates a cross-sectional front view of the paddleboard depicted in FIG. 2A illustrating an alternative configuration in accordance with some exemplary embodiments of the present invention.

In some exemplary embodiments, each of the oars 207 may have an adjustable length in order to facilitate exercises that require a user to stand up, as well as exercises that require a user to kneel or even sit on the board. FIG. 2B illustrates a cross-sectional front view of the paddleboard depicted in FIG. 2A illustrating the alternative configuration in accordance with some exemplary embodiments of the present invention, in which shortened oars 207 are utilized. This may be useful for implementing a different type of exercise (as mentioned above sitting versus standing up) as well as for use with smaller boards in which better balance is achieved while sitting or kneeling on the board.

Figure 3A:
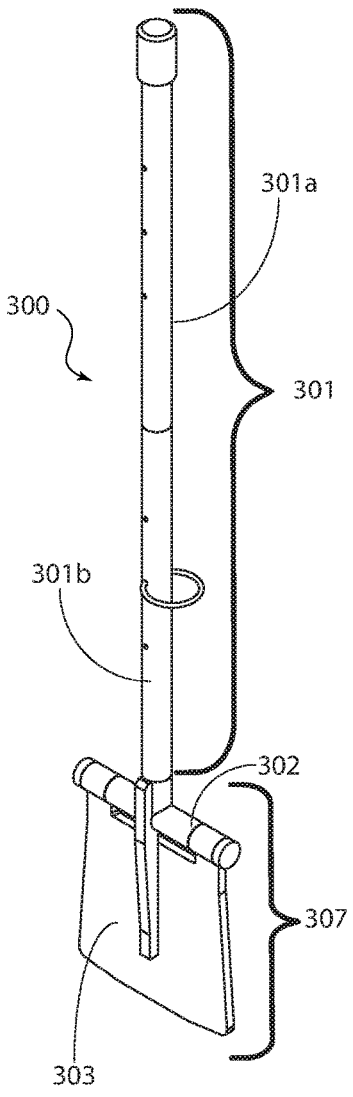
FIG. 3A illustrates a perspective front view of an oar for a kit in accordance with some embodiments of the preset invention.
Figure 3B:
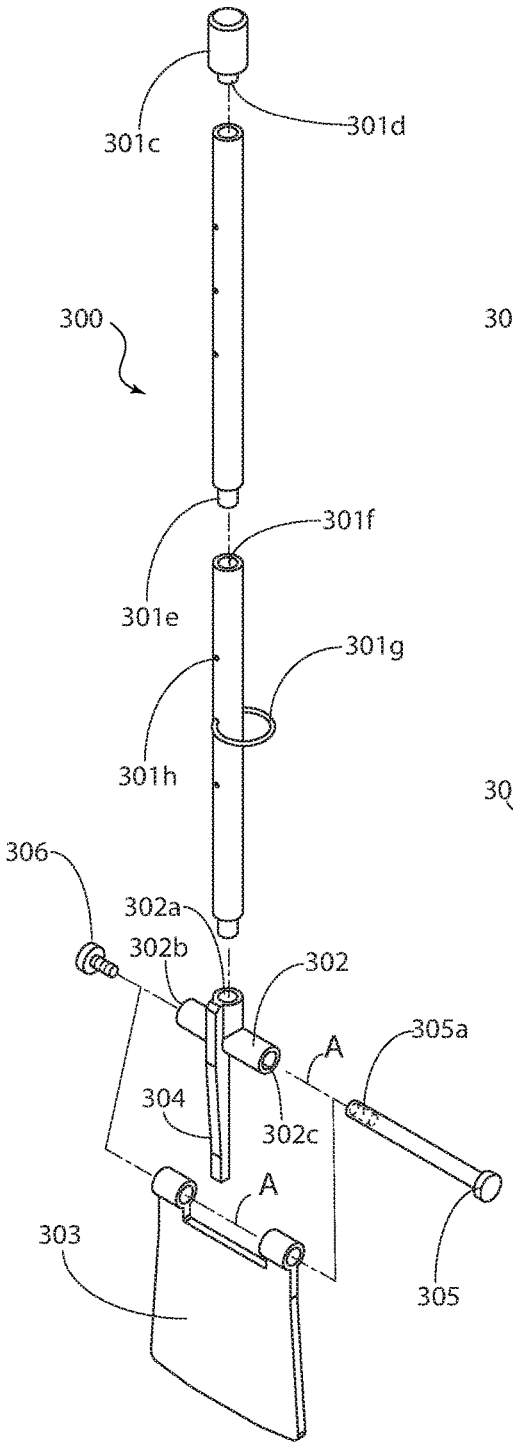
FIG. 3B illustrates a perspective exploded view of an oar for a kit in accordance with some embodiments of the preset invention.
Figure 3C:
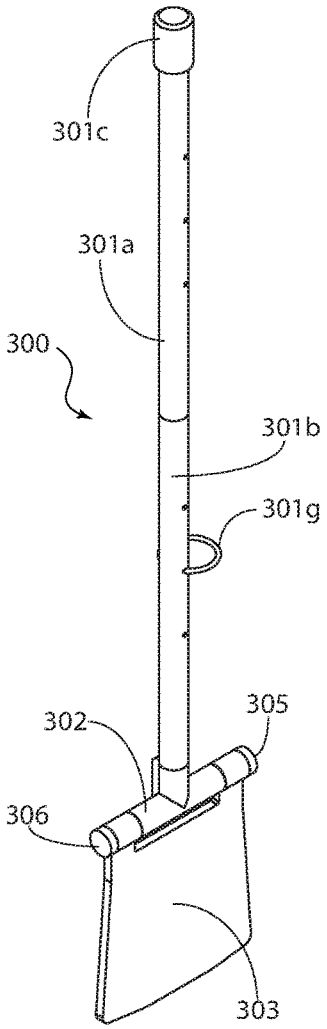
FIG. 3C illustrates a perspective back view of an oar for a kit in accordance with some embodiments of the preset invention.

Turning now to the next set of figures, FIG. 3A illustrates a perspective front view of an oar for a kit in accordance with some exemplary embodiments of the preset invention; FIG. 3B illustrates a perspective exploded view thereof; and FIG. 3C illustrates a perspective back view thereof. More specifically, this set of figures depicts an oar 300 with a pivotable paddle assembly 307 that enables each paddle to pivot in such a way that the blade portion holds a steady position in relation to a shaft portion on the power stroke whilst being free to fold in the opposite sense on the idle stroke. This configuration allows for the oars to remain in the water the entire time, rather than requiring the user to lift the oars to the side of the board, as would be generally required of oar movement during, for example boating or canoeing. This configuration or construction of oar 300 facilitates certain exercises that are not possible with boating or canoeing due to the range of motion typically required in those other sports.

As such, in accordance with some exemplary embodiments of the present invention, oar 300 comprises of a handle or shaft 301, which may preferably although not necessarily include removable segments 301*a* and 301*b* that allow shaft 301 to be elongated or shortened (as in the exemplary embodiment depicted in FIG. 2B). To secure oar 300 to an oar receiving member or frame on a respective coupler of an oar support assembly, each shaft 301 may include a support ring 301*g* that may be placed on one of a plurality of openings 301*h* situated along a length of each shaft 301. Moreover, to facilitate the removal and or connecting of each segment 301*a* and 301*b*, each segment may include a coupling terminal end 301*e* that registers with an opening (such as opening 301*f*) on shaft 301. Further, in exemplary embodiments such as the one illustrated here, a shaft cap 301*c* with a coupling terminal end 301*d* may be implemented for sealing the shaft 301 and maintaining it hollow. In embodiments in which openings 301*h* are implemented, it should be noted that these openings are preferably not through openings that would otherwise allow each shaft to fill up with water—as this would make it exceedingly difficult to row.

At a bottom terminal end of oar 300, a paddle support assembly 307 may be implemented; the paddle support assembly 307 including paddle support 302, paddle body 303 and paddle stop 304. Paddle support assembly 307 may be coupled to shaft 301 via paddle support 302 having a tubular body (for receiving a portion of shaft 301) coupled to paddle stop 304 parallel to the shaft 301. Further, paddle body 303 may be pivotably coupled to the paddle support 302 with a rod 305 perpendicular to the shaft 301 traversing the paddle support 302 and the paddle body 303, such that the paddle body 303 has a range of motion about a length of the rod 305 (or about axis A) that is limited by the paddle stop 304.

Accordingly, when oar 300 is used for rowing, the pivotable paddle assembly 307 enables each paddle body 303 to pivot in such a way that the blade portion of paddle body holds a steady position (supported by paddle stop 304) in relation to shaft 301 on the power stroke. However, paddle body 303 is free to fold in the opposite sense (or backwards) on the idle stroke (i.e. FIG. 7D) when each idle stroke is executed as a substantially axial thrust of shaft 301. This movement is facilitated as mentioned above by paddle stop 304, which extends from paddle support 302 including openings 302*a*, 302*b* and 302*c* for registering with shaft 301 and receiving rod 305 and securing member 306. In exemplary embodiments such as depicted in FIG. 3B, rod 305 includes an opening 305*a* at a first terminal end configured to register with securing member 306.

Figure 4A:
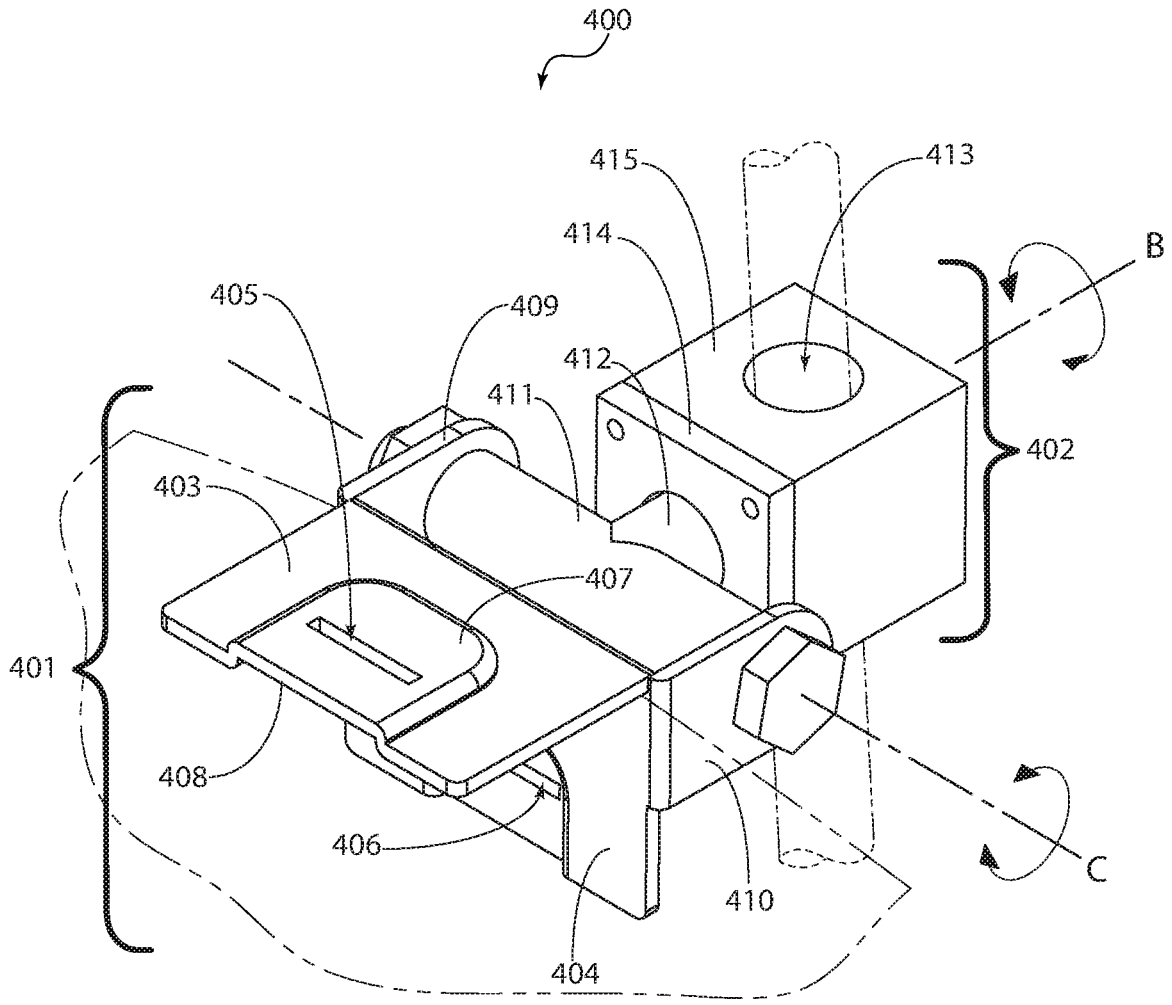
FIG. 4A illustrates a perspective view of a coupler for an oar attachment assembly in accordance with some exemplary embodiments of the present invention.
Figure 4B:
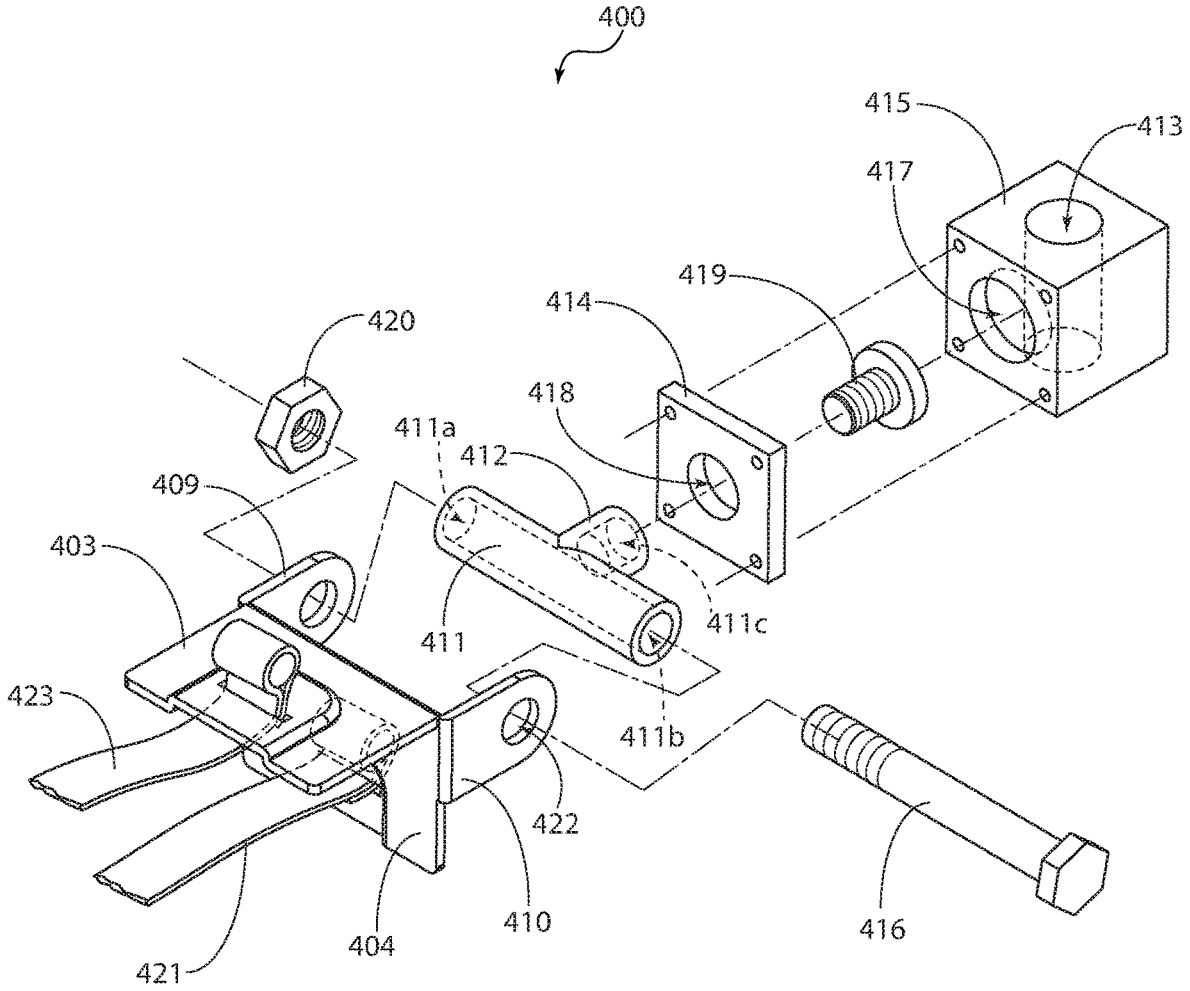
FIG. 4B illustrates a perspective exploded view of a coupler for an oar attachment assembly in accordance with some exemplary embodiments of the present invention.

Turning now to the next set of figures, FIG. 4A illustrates a perspective view of a board coupler for an oar attachment assembly in accordance with some exemplary embodiments of the present invention; and FIG. 4B illustrates a perspective exploded view of the board coupler depicted in FIG. 4A. More specifically, these figures show coupler 400, which comprises board support member 401 and oar receiving member 402. Typically, coupler 400 comprises board support member 401, which is configured to register with a top surface and an edge of a water sports board, and which is swivably connected or coupled to oar receiving member 402. Oar receiving member 402 may include an aperture 413 configured to receive one of the pair of oars, the oar receiving member 402 rotatably coupled to the board support member 401 such that the board support member 401 facilitates a rotation of the oar receiving member 402 about a longitudinal axis C of the board support member 401. Furthermore, the oar receiving member 402 further rotates about an axis B that is perpendicular to the longitudinal axis C of the board support member 401.

In exemplary embodiments, the board support member 401 comprises of an L-shaped bracket including perpendicular planar supports (i.e. a horizontal planar support 403 adapted to register with the top surface of the water sports board, and a vertical planar support 404 adapted to register with the edge of the water sports board.

In exemplary embodiments, a raised portion 407 may create an inlet 408 through which a portion of a strap 423 may be positioned and securely held in place whenever the strap is secured against a surface of a board. Each of the perpendicular planar supports of the L-shaped bracket may further include slots 405 and 406, respectively, for receiving the strap portions 423 and 421 therein. In such embodiment, the L-shaped bracket may include a fork end comprising of fork arms 409 and 410, which include openings 422 for receiving a tubular body 411 that facilitates the swiveling of board support member 401 about axis C, secured in place with a pin or a rod 416 and fastener (such as a nut or the like) 420.

In some exemplary embodiments, the rotation of oar receiving member 402 may be facilitated by a perpendicular member 412, which extends from tubular body 411 of board support member 401. For example, and without limiting the scope of the present invention, oar receiving member 402 may include a cubical frame 415, which includes a base aperture 417 and a base 414 that together with a coupling component 419 may be secured to perpendicular member 412, which includes openings 411*a* and 411*b* for receiving rod 416 therethrough, as well as an opening 411*c* for receiving coupling component 419 therein, and which allow for a rotation of the cubical frame 415 (together with base 414) of the oar receiving member 402.

Figure 5A:
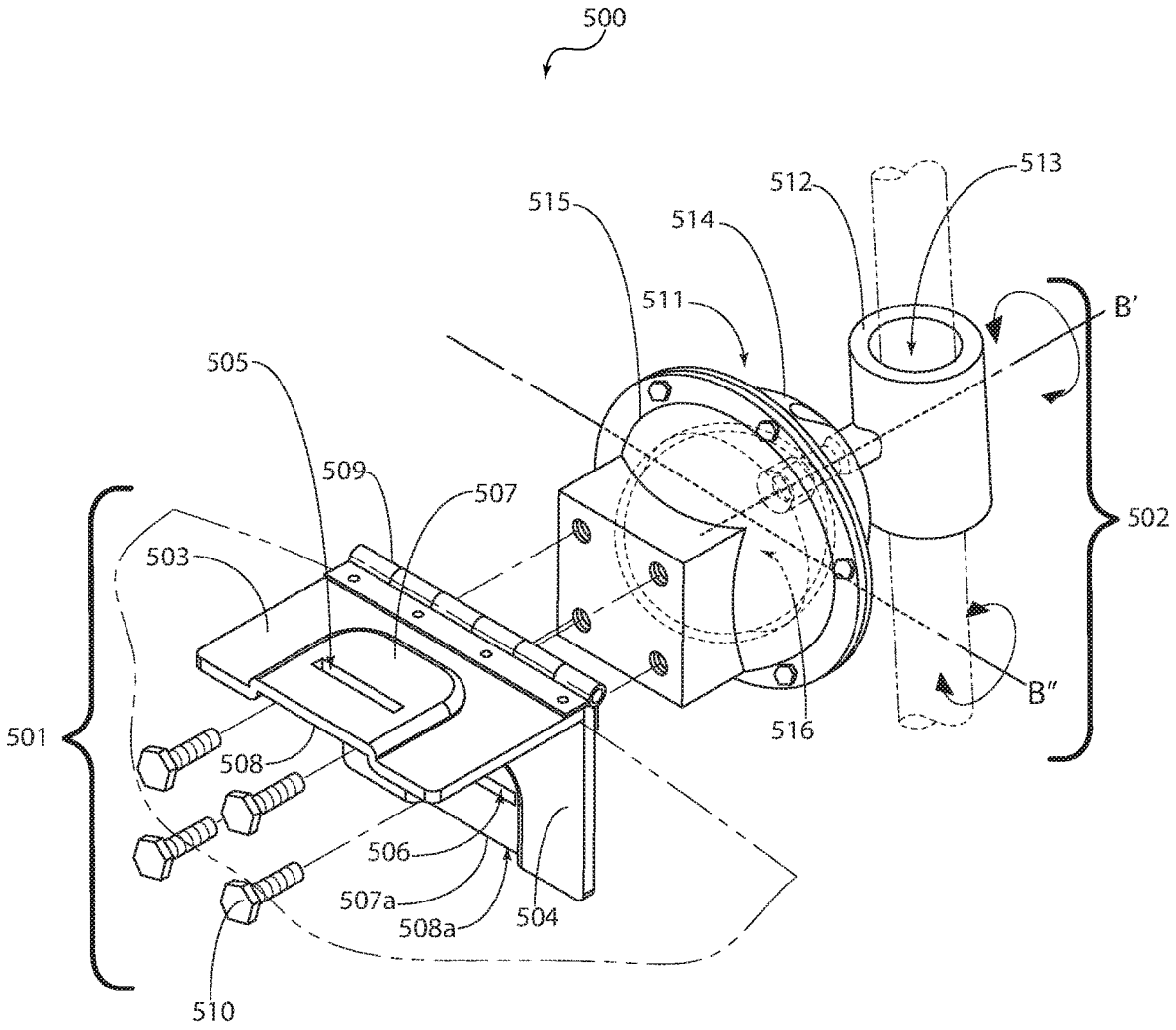
FIG. 5A illustrates a perspective exploded view of a coupler for an oar attachment assembly in accordance with some exemplary embodiments of the present invention.
Figure 5B:
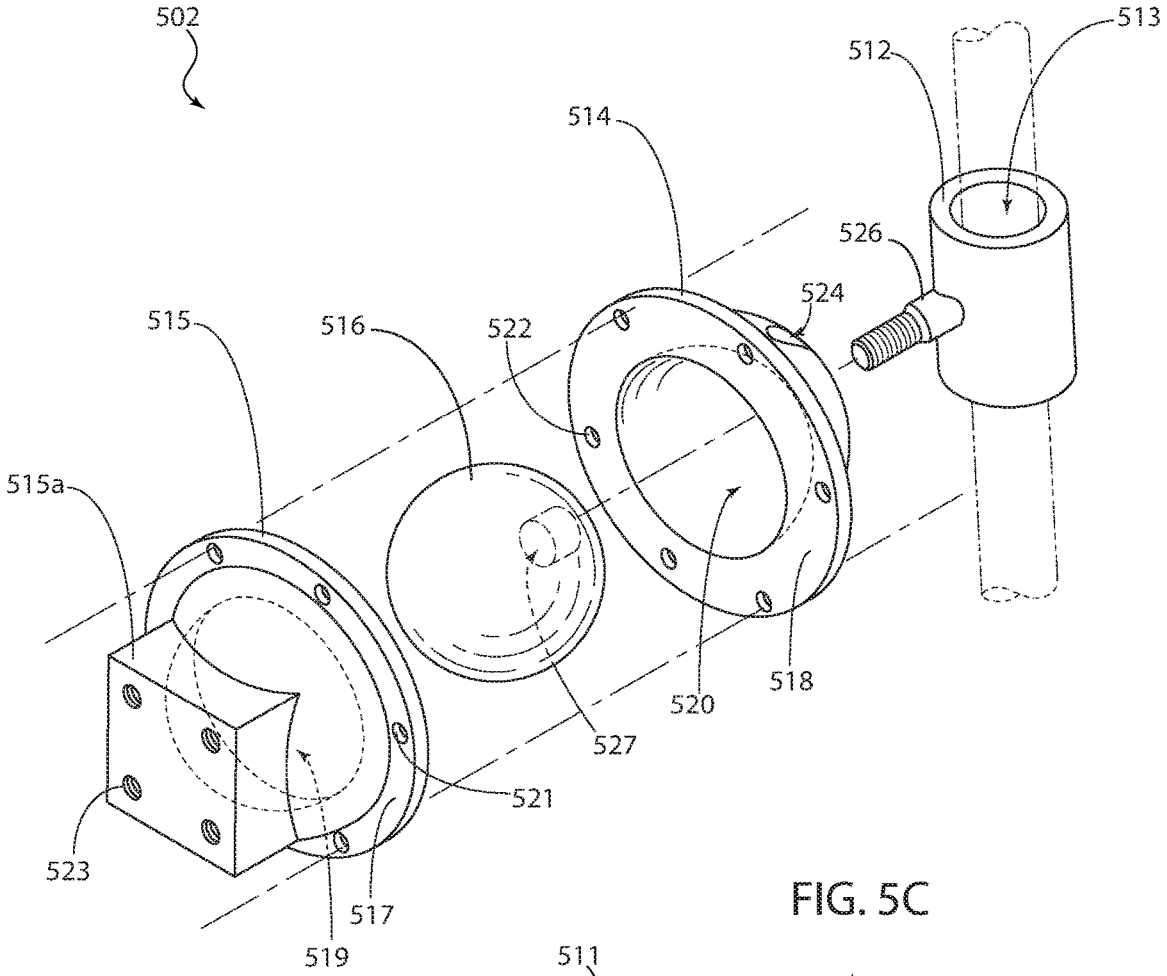
FIG. 5B illustrates a perspective exploded view of an oar receiving member for the coupler depicted in FIG. 5A.
Figure 5C:
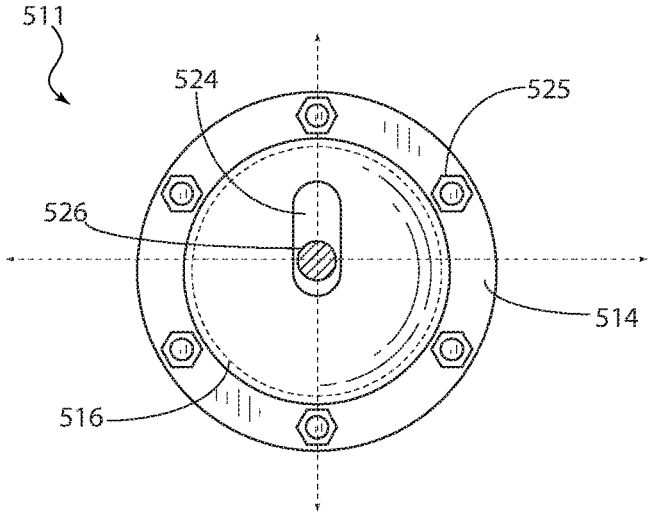
FIG. 5C illustrates a front view of the oar receiving member depicted in FIG. 5B.
Figure 5D:
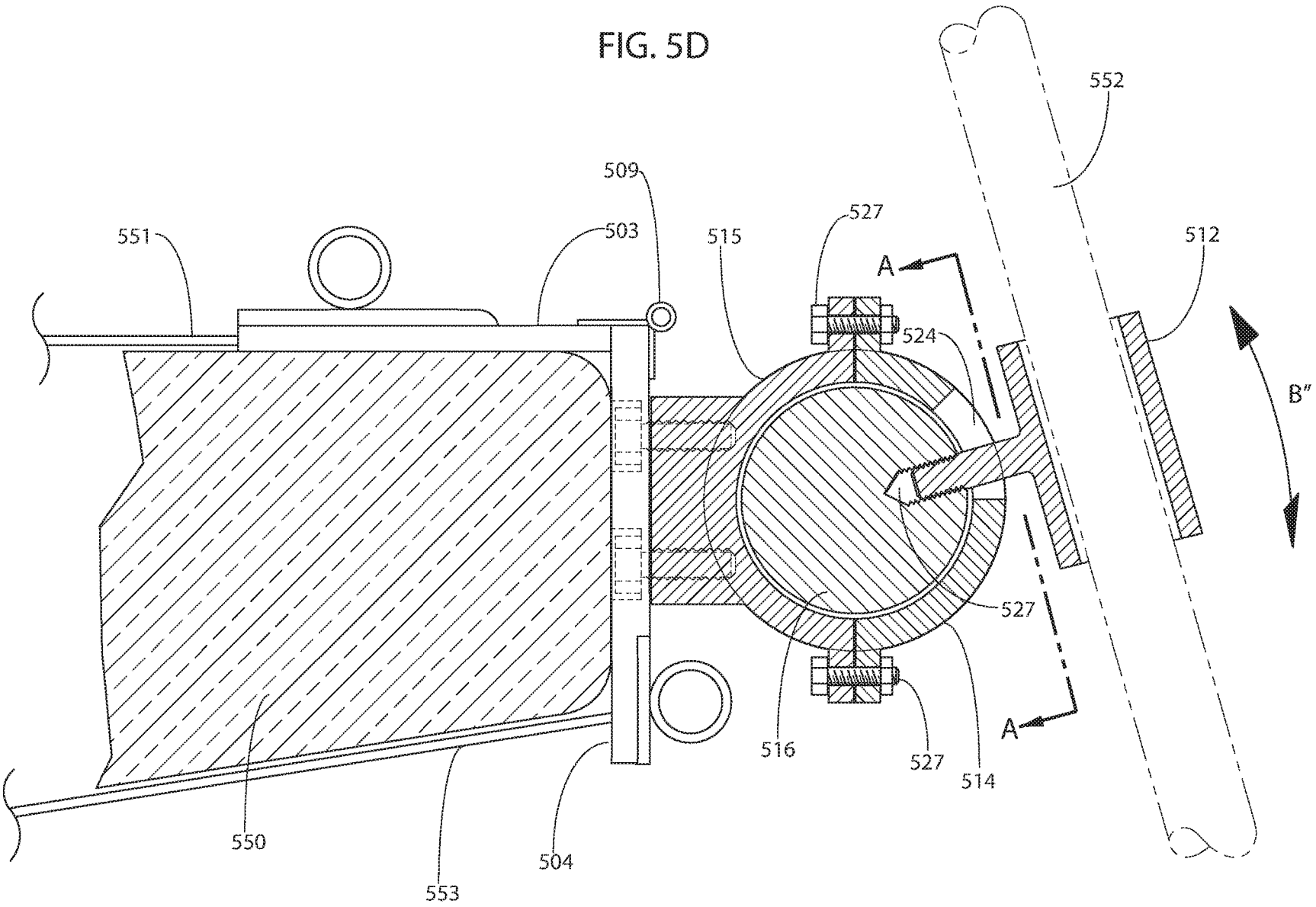
FIG. 5D illustrates a cross-sectional view of the coupler depicted in FIG. 5A coupled to a water sports board in accordance with some exemplary embodiments of the present invention.

Turning now to the next set of figures, FIG. 5A illustrates a perspective exploded view of a coupler for an oar attachment assembly in accordance with some exemplary embodiments of the present invention; FIG. 5B illustrates a perspective exploded view of an oar receiving member for the coupler depicted in FIG. 5A; FIG. 5C illustrates a front view of a housing for the oar receiving member depicted in FIG. 5B; and FIG. 5D illustrates a cross-sectional view of the coupler depicted in FIG. 5A coupled to a water sports board in accordance with some exemplary embodiments of the present invention. More specifically, these figures show coupler 500, which comprises board support member 501 and oar receiving member 502, shown in one view coupled to water sports board 550.

As with other embodiments discussed above, board support member 501 may comprise of an L-shaped bracket configured to register with a top surface and an edge of a water sports board. In exemplary embodiments, the L-shaped bracket may include perpendicular planar supports (i.e. a horizontal planar support 503 adapted to register with the top surface of the water sports board, and a vertical planar support 504 adapted to register with the edge of the water sports board). In exemplary embodiments, a raised portion 507 may create an inlet 508 through which a portion of a strap (i.e. such as strap 423) may be positioned and securely held in place whenever the strap is secured against a top surface of a board. Similarly, a raised portion 507*a* may create an inlet 508*a* through which a portion of a strap (i.e. such as strap 423) may be positioned and securely held in place whenever the strap is secured against an edge of the board. Each of the perpendicular planar supports of the L-shaped bracket may further include slots 505 and 506, respectively, for receiving strap portions therein. Moreover, although horizontal planar support 503 and vertical planar support 504 are shown substantially planar (i.e. planar albeit raised portions 507 and 507*a*) each support of board support member 501 may include a concaved portion or curvature that matches a curvature of a board.

In exemplary embodiment such as shown in this figure, the L-shaped bracket may include a hinge 509 swivably connecting horizontal planar support 503 with vertical planar support 504. One or more coupling components such as screws 510 may secure board support member 501 to oar receiving member 502. In other exemplary embodiments, the oar receiving member 502 is integral with board support member 501.

In some exemplary embodiments, oar receiving member 502 comprises a swivel ball joint or spherical housing 511 coupled to an oar retaining arm 512, which includes an aperture 513 for receiving a portion of an oar. The spherical housing 511 may be formed by a first semispherical component 514 and a second semispherical component 515 that encloses a sphere component or ball 516 within a spherical cavity defined by an interior of each semispherical component 514 and semispherical component 515. The ball 516 may be sized slightly smaller than the cavity therein such that ball 516 is free to move or rotate within the cavity.

In exemplary embodiments, ball 516 includes an aperture 527 configured to receive a portion of oar retaining arm 512, or member 526, which extends from a tubular body of oar retaining arm 512. Because member 526 is secured to ball 516, movement of oar retaining arm 512 is facilitated both about axis B' or in a forward and backward direction, and about axis B" or in an up and down direction; in this way, a user may swivel or rotate each oar longitudinally (by for example moving each oar receiving member 502 forwards and backwards with respect to the length of the board and about axis B') and swivel or rotate each oar laterally (from left to right or side to side with respect to a length of the board and about axis B").

Oar retaining arm 512 may include a tubular body forming aperture 513 configured to receive one of the pair of oars, the retaining arm 512 rotatably coupled to the spherical housing 511 (and more specifically to ball 516) such that the spherical housing 511 rotates the retaining arm 512 in both a forward and backward direction, and an up and down direction as mentioned above.

In some exemplary embodiments, the spherical housing comprising semispherical component 514 and semispherical component 515 may be coupled together by, for example, fasteners or bolts 525 connecting the two semispherical components 514 and 515 together, each semispherical component including openings 521 and 522 around a flat circumference 517 and 518, respectively, that extend from the dome portion forming each semispherical component. These openings 521 and 522 around a flat circumference 517 and 518 may be configured to receive a plurality of bolts 525 that in turn secure each semispherical component to each other. In exemplary embodiments such as the one shown in FIG. 5B, semispherical component 514 may include an aperture 524 configured to receive a portion of the oar retaining arm 512 (or member 526). Moreover, the spherical housing may be coupled to board support member 501 by implementation of a base 515*a* that extends from the domed portion of semispherical component 515, which may be secured against board support member 501 via a plurality of fasteners such as bolts or screws 510 inserted in openings 523 of base 515*a*.

Although the embodiment of coupler 500 is slightly different than the embodiments disclosed with reference to FIG. 4A or FIG. 4B, couplers 500 may be employed with a kit in accordance with the present invention without limiting the scope of this disclosure. That is, kit 100, for example, may employ couplers such as those shown in FIG. 1, or couplers such as those shown in FIG. 4A-FIG. 4B and or couplers 500, as well as oars such as oars 102 and or oars 207 and or oars 300, and or oars 552 without limiting the scope of the present invention.

Accordingly, a paddleboard kit 100, in accordance with some embodiments of the present invention, may comprise a pair of oars 552 with pivotable paddles (e.g. paddles 303); and an oar support assembly including a pair of board couplers 500 coupled to a strap 551 for securing the oar support assembly and the pair of oars 552 to a water sports board 550, each of the pair of board couplers 500 comprising: a board support member 501 configured to register with a top surface and an edge of the water sports board 550 and a hinge 509 for adjusting an angle of the board support member 501; and an oar receiving member 502 including a base 515*a* coupled to the board support member 501 and an oar retaining arm 512 configured to receive an oar of the pair of oars 552 with pivotable paddles and move the oar longitudinally and laterally with respect to a length of the water sports board 550.

Similarly, a paddleboard kit, in accordance with some embodiments of the present invention, comprises: a pair of oars 552 with pivotable paddles (e.g. paddles 303); and an oar support assembly 200 including a pair of board couplers 500 coupled to a strap 551 for securing the oar support assembly 200 and the pair of oars 552 to a water sports board 550, each of the pair of board couplers 500 comprising: a board support member 501, including an L-shaped bracket configured to register with a top surface and an edge of the water sports board 550; and an oar receiving member 502, including: a spherical housing 511 coupled to an oar retaining arm 526 comprising an aperture 513 for receiving a portion of an oar, wherein: the spherical housing 511 is defined by a first semispherical component 514 and a second semispherical component 515 that house a ball 516 within a spherical cavity (i.e. formed by semispherical cavities 519, 520) defined by an interior of each of the first and second semispherical components 514, 515; and wherein the ball 516 is sized slightly smaller than the cavity such that ball 516 is free to move or rotate within the cavity.

Moreover, a paddleboard kit, in accordance with some embodiments of the present invention, comprises: a pair of oars 552 with pivotable paddles (e.g. paddles 303); and an oar support assembly 200 including a pair of board couplers 500 adjustably coupled to a portion of a strap 551 for securing the oar support assembly 200 and the pair of oars 552 to a water sports board 550, each of the pair of board couplers 500 comprising: a board support member 501 configured to register with a top surface and an edge of the water sports board 550; and an oar receiving member 502 coupled to the board support member 501, wherein: the oar receiving member 502 includes a spherical housing 511 coupled to a retaining arm 512 having a tubular body; and wherein the spherical housing 511 encloses a ball 516 exposed partially via an aperture 524 configured to receive apportion of the oar retaining arm 512 (or member 526) such that the ball 516 rotates the retaining arm 512 in both an up and down direction and a side to side direction.

Figure 6:
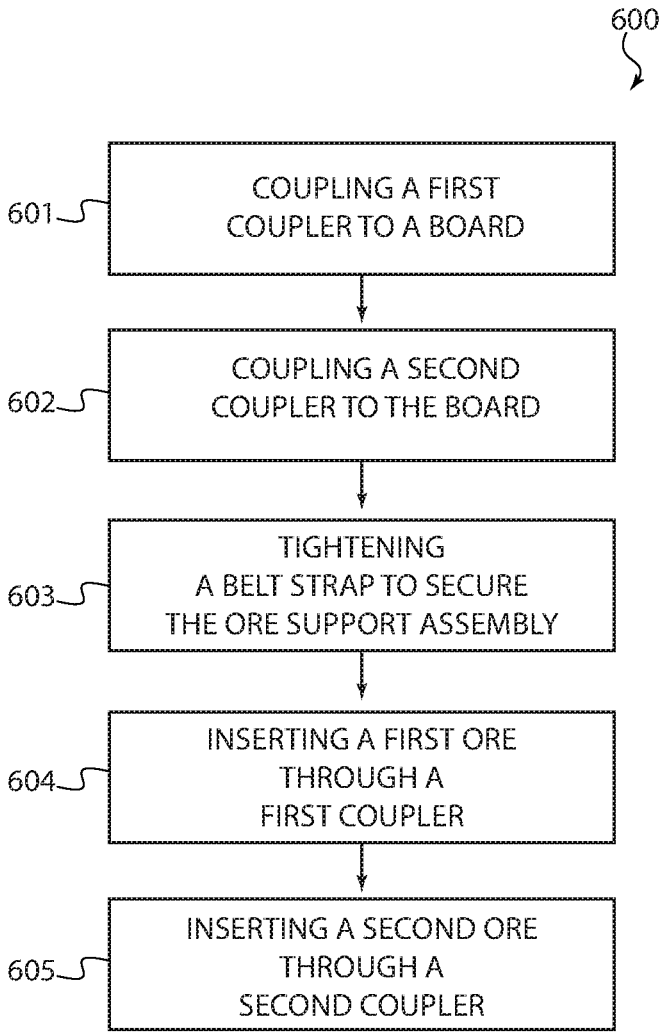
FIG. 6 illustrates a flow chart depicting a method of putting together a kit for retrofitting a water sports board in accordance with practice of the present invention.

Putting together a kit in accordance with the present invention, in order to retrofit a board, such as a surfboard into a paddleboard, is easily accomplished. The next figure, illustrates a simple flow chart of several exemplary steps that may be taken in use of a kit in accordance with the present invention. More specifically, FIG. 6 illustrates a flow chart depicting method 600 of putting together a kit for retrofitting a water sports board into a paddleboard. Although shown in a particular sequence of steps, it is noted that alternative sequence of steps may be possible without deviating from the scope of the present invention.

In step 601, a first board coupler of an oar support assembly may be coupled to the water sports board. This may be achieved by placing, for example, a wall of the board against a board support member such as board support member 501; and more specifically, by placing an edge of a wall of the board against vertical planar support 504 and a surface of the board against horizontal planar support 503 (of the L-shaped bracket that makes up the board support member 501).

In step 602, a second board coupler of the oar support assembly may be coupled to the water sports board in a similar fashion, so that (for example) the L-shaped bracket is likewise tightly held against the top surface and side wall of the board.

In step 603, a strap 551 and a strap 553 may be adjustably coupled between the first board coupler and the second board coupler of the oar support assembly and tightened (for example with the aid of fasteners such as a fastener 107 or a set of fasteners 204 (depending on the embodiment of the device) such that the water sports board is snuggly secured therein between the first board coupler and the second board coupler of the oar support assembly.

In step 604, a first oar including a first pivotable paddle (such as oar 300) may be inserted through the first board coupler and secured, for example with a securing or support ring or similar component (such as support ring 301*g*) in order to prevent the oar from falling into the water when in use.

Finally, and in a similar fashion as in the previous step, in step 605, a second oar including a second pivotable paddle may be inserted through the second board coupler, similarly securing the oar with a support ring or similar component (such as support ring 301*g*) in order to prevent the oar from falling into the water when in use.

Figures 7A, 7B, 7C, 7D:
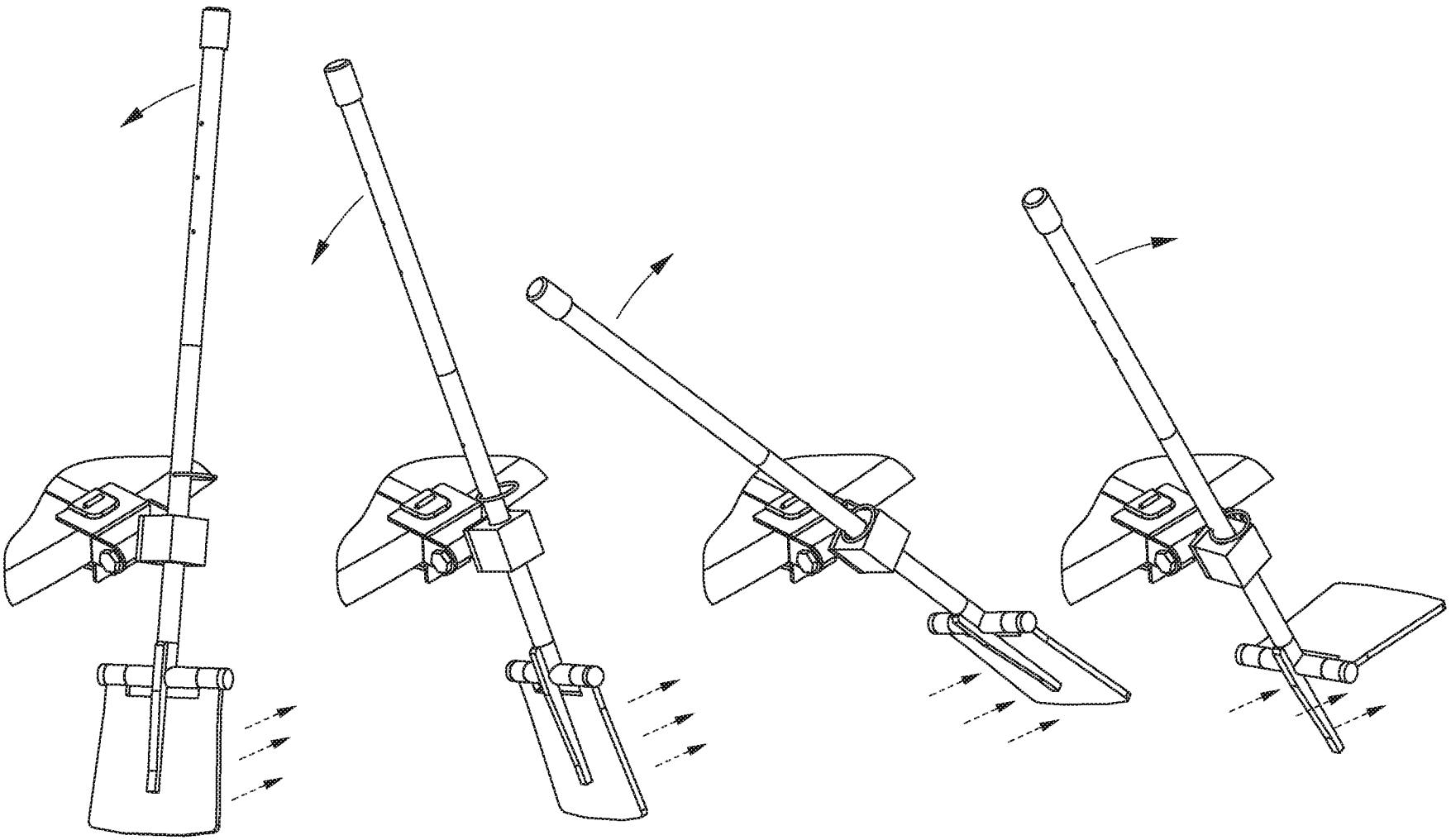
FIG. 7A-FIG. 7D illustrate the range of motion and movement of components of an oar with pivotable paddles in accordance with the present invention.

Now turning to the next set of figures, FIG. 7A-FIG. 7D illustrate the range of motion and movement of components of an oar in accordance with the present invention. More specifically, FIG. 7A depicts an oar such as oar 300 at a starting point of a power stroke; FIG. 7B depicts the oar during the power stroke revealing that the paddle body remains fixed thereby pushing water and thereby propelling the board. FIG. 7C depicts the limit of such movement, at which point a user is about to pull back in an idle stroke of the oar; and finally, FIG. 7D depicts what occurs when the oar is pulled back during the idle stroke, causing the paddle body to swivel back-allowing water to flow.

Figure 8A:
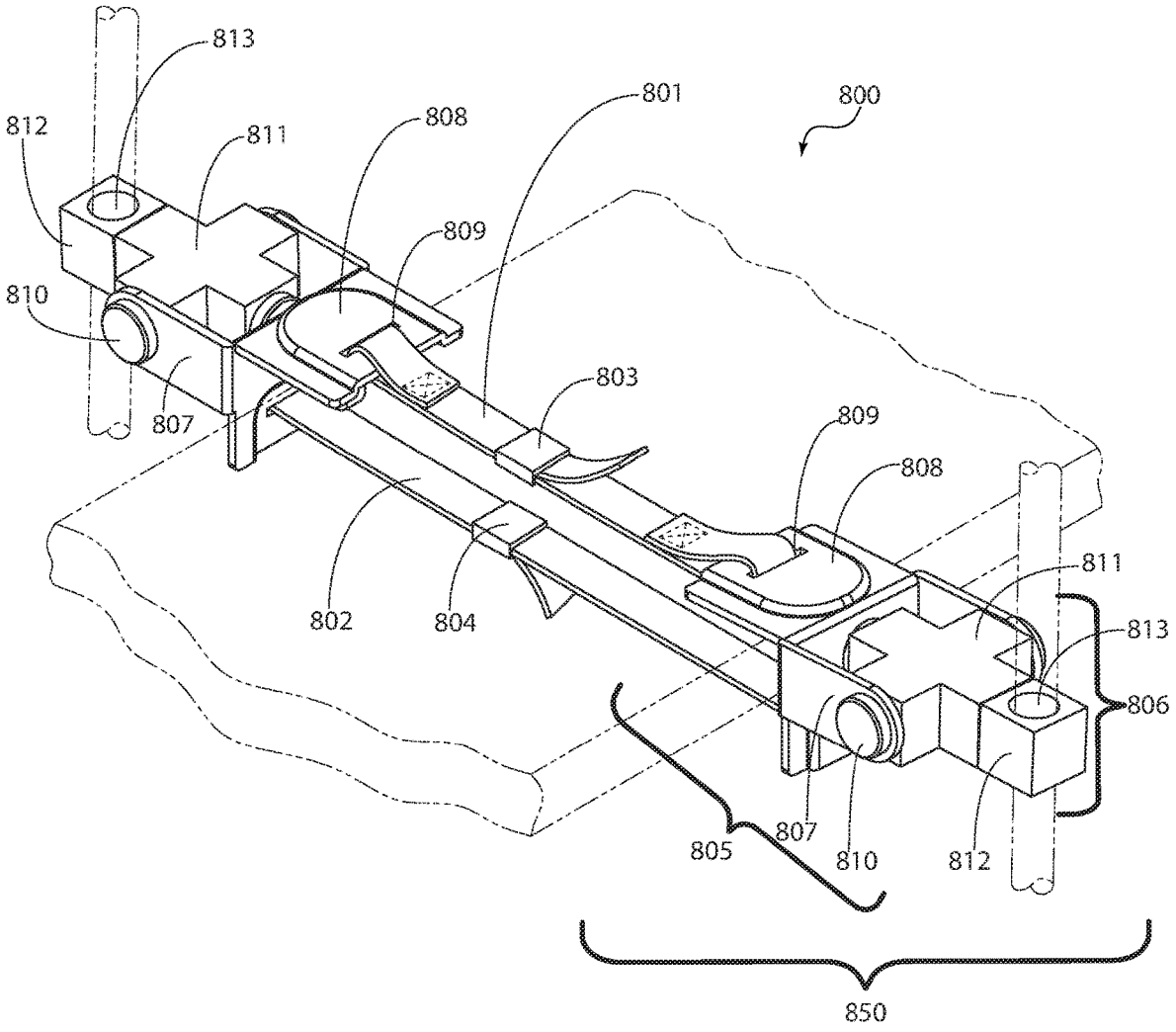
FIG. 8A illustrates a perspective view of an adjustable belt and couplers for an oar attachment assembly in accordance with some exemplary embodiments of the present invention.
Figure 8B:
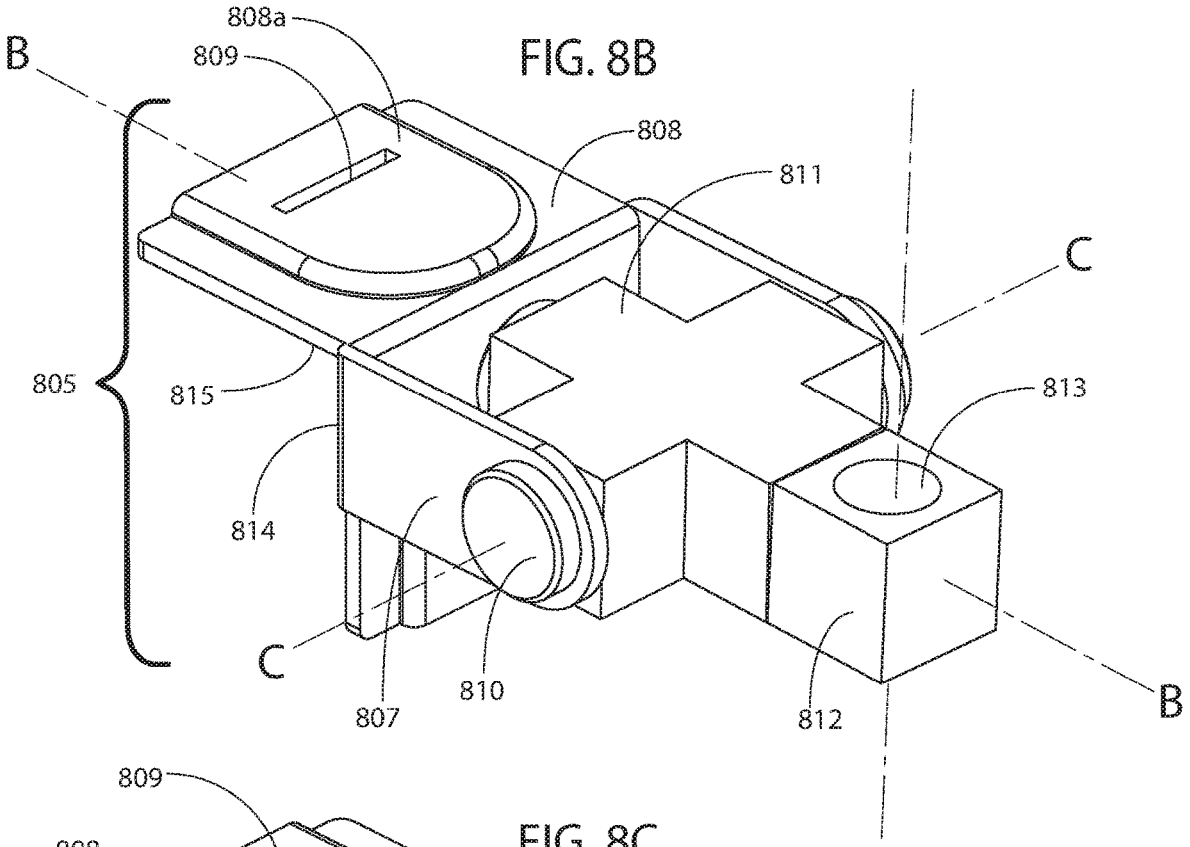
FIG. 8B-FIG. 8C illustrate a perspective views of one of the couplers depicted in FIG. 8A, showing the movement of the coupler about its axes.
Figure 8C:
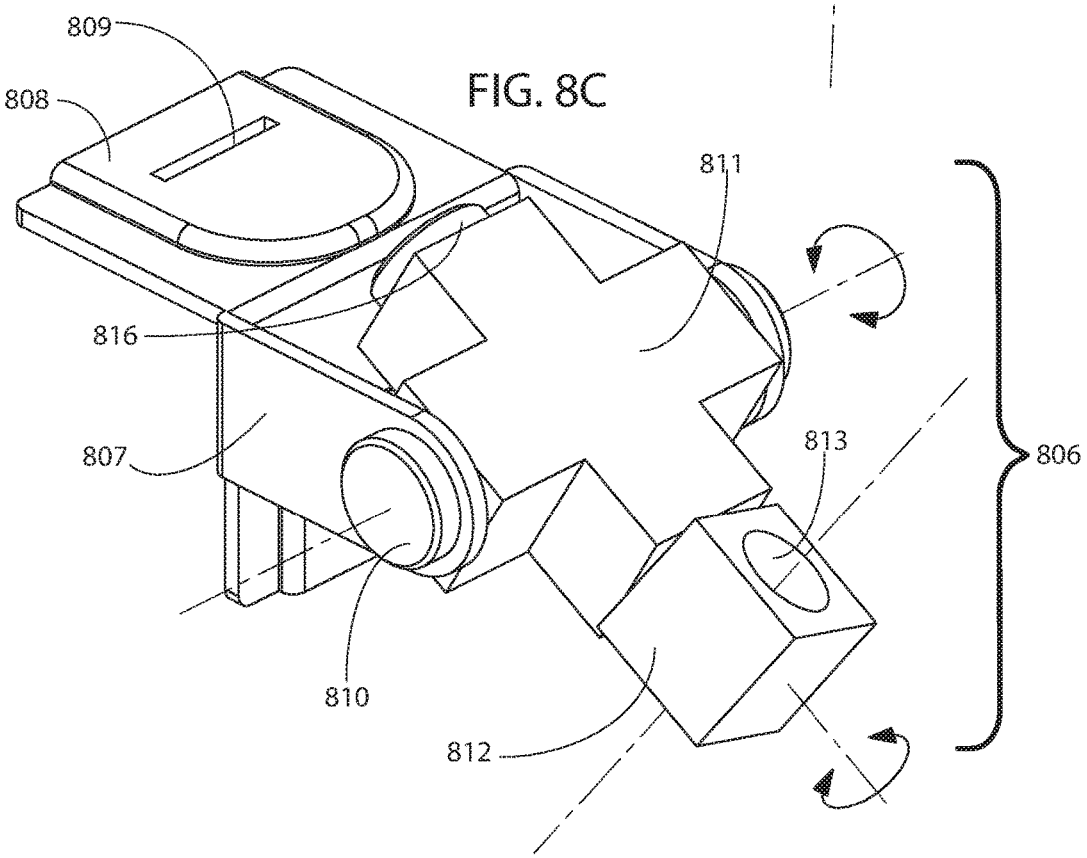
Figure 8D:
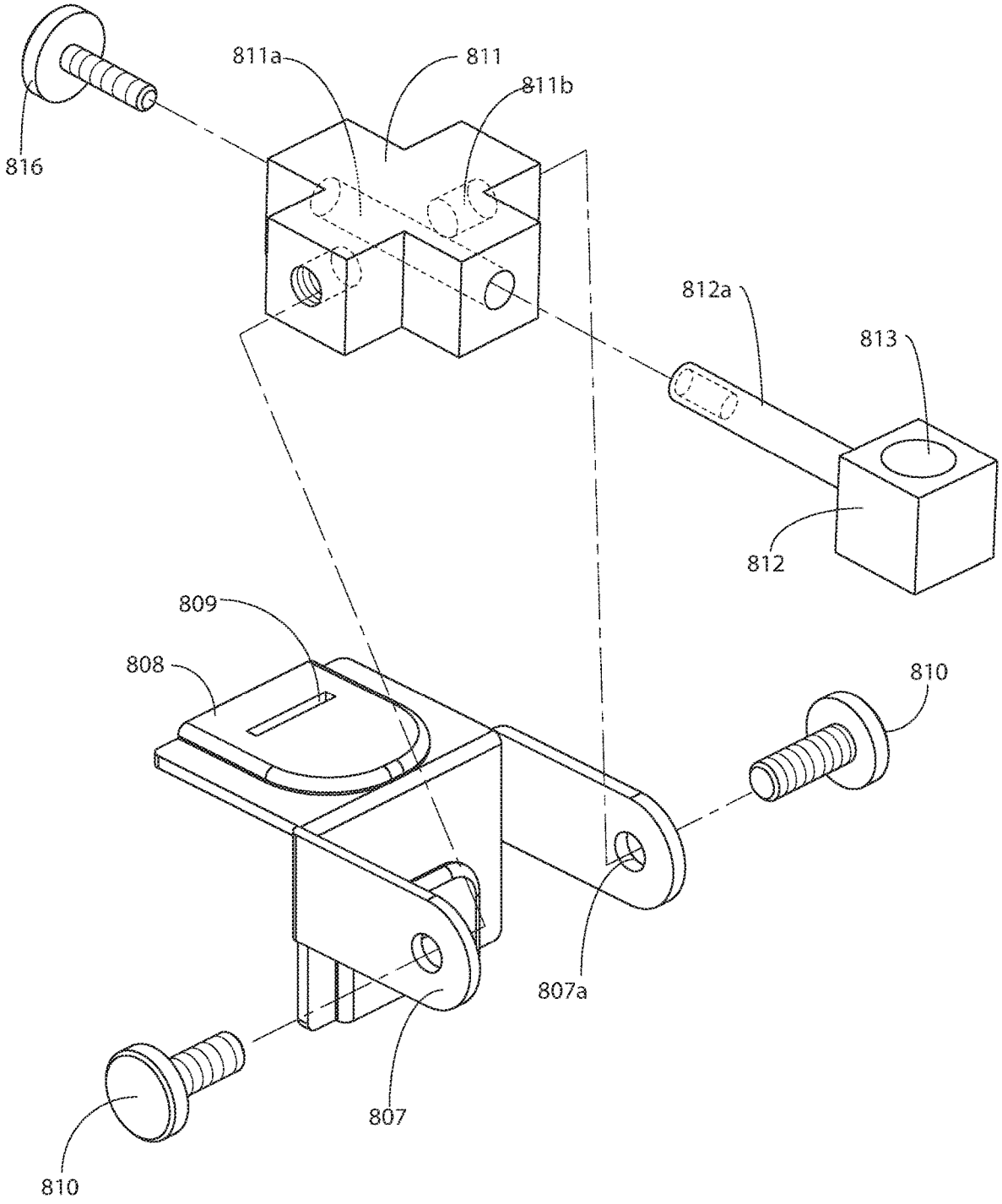
FIG. 8D illustrates a perspective exploded view of one of the couplers depicted in FIG. 8A, showing the movement of the coupler about its axes.

Turning now to the next set of figures, FIG. 8A illustrates a perspective view of an adjustable belt and couplers for an oar attachment assembly in accordance with some exemplary embodiments of the present invention; FIG. 8B-FIG. 8C illustrate perspective views thereof, showing the movement of the coupler about its axes; and FIG. 8D illustrates a perspective exploded view thereof. More specifically, FIG. 8A depicts a kit, which includes oar support assembly 800 for securing oars to a water sports board, in accordance with the present invention, in a manner such that a desired range of movement is provided for each oar, and so that the oars and oar support assembly may be easily removed and the board used as it may be originally intended.

In this exemplary embodiment, the oar assembly comprises a pair of board couplers 850, each including a board support member 805 configured to register with a top surface and an edge of the board in a manner similar to embodiments discussed above. Moreover, each board support member 805 is coupled to an oar receiving member 806, each including apertures on a support frame configured to receive one of the pair of oars. The oar receiving members 806 are each rotatably coupled to the board support members 805 such that the board support member 805 rotates the oar receiving member 806 about a longitudinal axis of the board support member 805. Further, in some exemplary embodiments, each oar receiving member 806 also rotates about an axis that is perpendicular to the longitudinal axis of the board support member 805; in this way, the user may swivel or rotate each oar laterally (i.e. moving each oar support member 806 so that an oar received therein moves from left to right or side to side with respect to a length of the board) and swivel or rotate each oar longitudinally (i.e. moving each oar receiving member 806 so that an oar received therein moves forwards and backwards with respect to the length of the board).

In exemplary embodiments, to secure each board coupler (and thus oar support assembly) to the board, a first belt or strap 801 may be coupled or fastened in-between a top surface of the board. Similarly, a second belt or strap 802 may be coupled or fastened in-between a bottom surface of the board. Preferably, although not necessarily, each strap may be adjustable with one or more fasteners 803 and 804 respectively.

As mentioned above, FIGS. 8A-8D show coupler 850, which comprises board support member 805 and oar receiving member 806. Typically, coupler 850 comprises board support member 805, which is configured to register with a top surface and an edge of a water sports board, and which is swivably connected or coupled to oar receiving member 806. Oar receiving member 806 may include an aperture 813 configured to receive one of the pair of oars, the oar receiving member 806 rotatably coupled to the board support member 805 such that the board support member 805 facilitates a rotation of the oar receiving member 806 about a longitudinal axis C of the board support member 805. Furthermore, the oar receiving member 806 further rotates about an axis B that is perpendicular to the longitudinal axis C of the board support member 805.

In exemplary embodiments, the board support member 805 comprises of an L-shaped bracket including perpendicular planar supports (i.e. a horizontal planar support 815 adapted to register with the top surface of the water sports board, and a vertical planar support 814 adapted to register with the edge of the water sports board).

In exemplary embodiments, a raised portion 808*a* may create an inlet 809 through which a portion of strap 801 may be positioned and securely held in place whenever the strap is secured against a surface of a board. Each of the perpendicular planar supports of the L-shaped bracket may further include slots 809 for receiving straps 801 and 802 therein. In such embodiment, the L-shaped bracket may include a fork end 807 comprising of fork arms that including an opening 807*a* for receiving bolts 810 that facilitates the swiveling of oar support member 806 about axis C.

In some exemplary embodiments, the rotation of oar receiving member 806 may be facilitated by a swivable body 811 of oar support member 806, which is swivably coupled to the fork arms of fork end 807 of board support member 805. In the shown embodiment of this set of figures, and without limiting the scope of the present invention, oar receiving member 806 may include swivable body 811, which includes a rotatable base 812 having an aperture 813 for receiving an oar therein. This may be exemplarily achieved by inserting a longitudinal member 812*a* of rotatable base 812 through a channel 811*a* of swivable body 811 and securing longitudinal member 812*a* with a bolt or screw 816, as depicted by way of example in FIG. 8D.

Figure 9A:
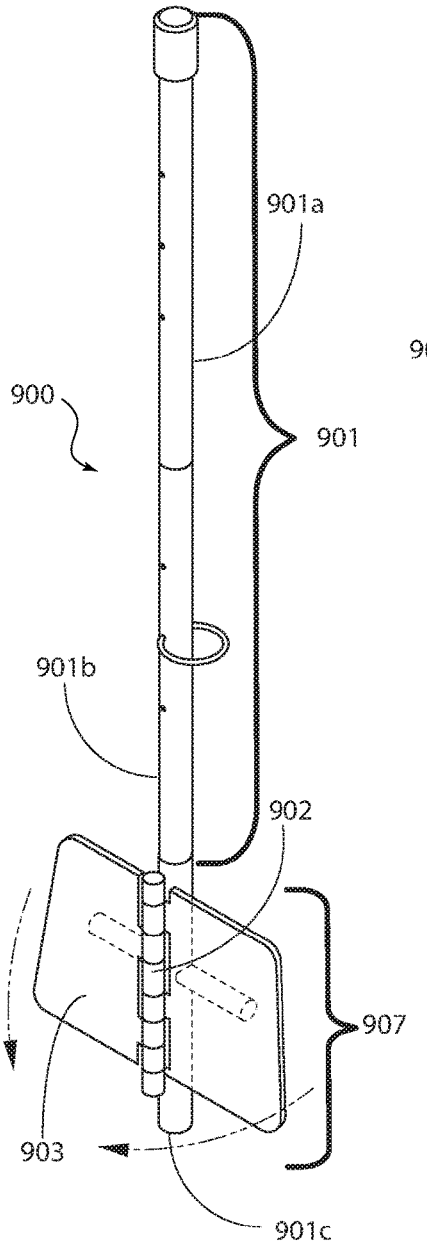
FIG. 9A illustrates a perspective front view of an oar for a kit in accordance with some embodiments of the preset invention.
Figure 9B:
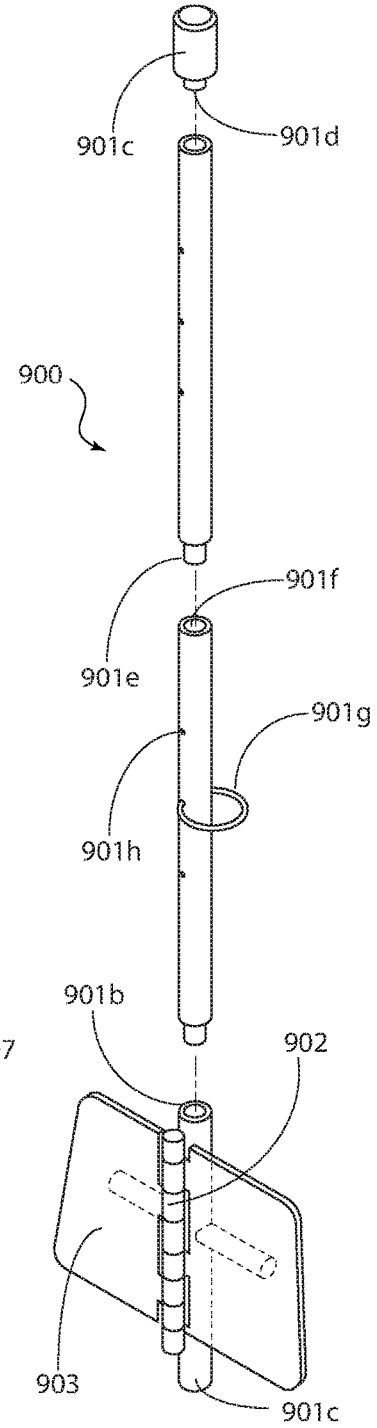
FIG. 9B illustrates a perspective exploded view of an oar for a kit in accordance with some embodiments of the preset invention.
Figure 9C:
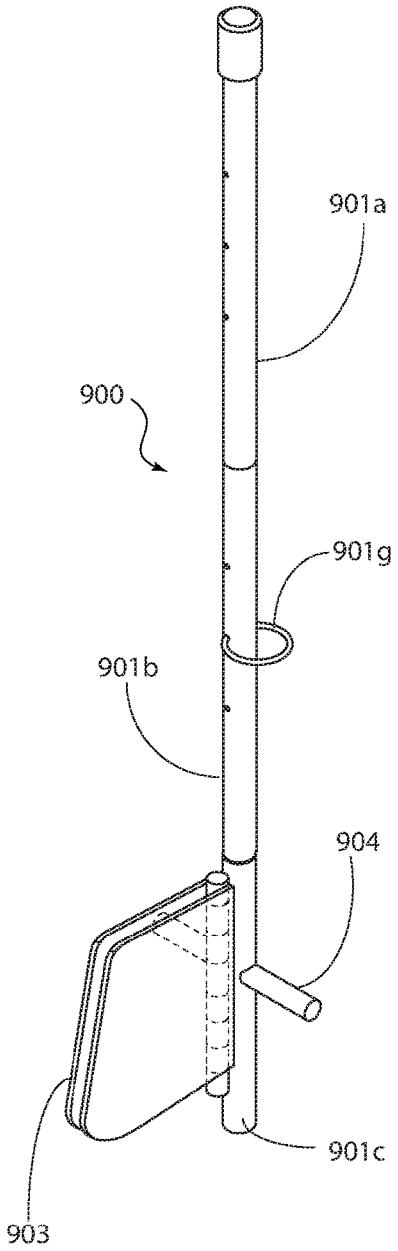
FIG. 9C illustrates a perspective view of an oar for a kit in accordance with some embodiments of the preset invention.

Turning now to the next set of figures, FIG. 9A illustrates a perspective front view of an oar for a kit in accordance with some embodiments of the preset invention; FIG. 9B illustrates a perspective exploded view thereof; and FIG. 9C illustrates a perspective view in which the paddle is depicted in an inactive position. More specifically, this set of figures depicts an oar 900 with a pivotable paddle assembly 907 that enables each paddle to pivot in such a way that the blade portion holds a steady position in relation to a shaft portion on the power stroke whilst being free to fold in the opposite sense on the idle stroke. This configuration allows for the oars to remain in the water the entire time, rather than requiring the user to lift the oars to the side of the board, as would be generally required of oar movement during, for example boating or canoeing. As mentioned with reference to the embodiment of oars depicted in FIGS. 3A-3C above, configuration or construction of oar 900 facilitates certain exercises that are not possible with boating or canoeing due to the range of motion typically required in those other sports.

As such, in accordance with some exemplary embodiments of the present invention, oar 900 comprises of a handle or shaft 901, which may preferably although not necessarily include removable segments 901*a* and 901*b* that allow shaft 901 to be elongated or shortened (as in the exemplary embodiment depicted in FIG. 2B). To secure oar 900 to an oar receiving member or frame on a respective coupler of an oar support assembly, each shaft 901 may include a support ring 901*g* that may be placed on one of a plurality of openings 901*h* situated along a length of each shaft 901. Moreover, to facilitate the removal and or connecting of each segment 901*a* and 901*b*, each segment may include a coupling terminal end 901*e* that registers with an opening (such as opening 9010 on shaft 901. Further, in exemplary embodiments such as the one illustrated here, a shaft cap 901*c* with a coupling terminal end 901*d* may be implemented for sealing the shaft 901 and maintaining it hollow. In embodiments in which openings 901*h* are implemented, it should be noted that these openings are preferably not through openings that would otherwise allow each shaft to fill up with water—as this would make it exceedingly difficult to row.

At a bottom terminal end of oar 900, a paddle support assembly 907 may be implemented; the paddle support assembly 907 including a paddle support 901*c* that includes a hinge 902 along a longitudinal axis running parallel to shaft 901, a paddle body 903 comprising to paddles swivably connected by hinge 902, and paddle stop 904. Paddle support assembly 307 may be coupled to shaft 901 via paddle support 901*c* having a tubular body (for receiving a portion of shaft 901). In exemplary embodiments, paddle stop 904 may include two small shafts extending from paddle support 901*c* and perpendicular to shaft 901 and paddle support 901*c*. Paddle body 903 typically has a range of motion about a length of the hinge 902 that is limited by the paddle stop 904.

Accordingly, when oar 900 is used for rowing, the pivotable paddle assembly 907 enables each paddle body 903 to pivot in such a way that the blade portions of paddle body 903 hold a steady position (supported by paddle stop 904) in relation to shaft 901 on the power stroke. However, paddle body 903 is free to fold in the opposite sense (or backwards) on the idle stroke (i.e. FIG. 9C) when each idle stroke is executed as a substantially axial thrust of shaft 901.

Figure 10A:
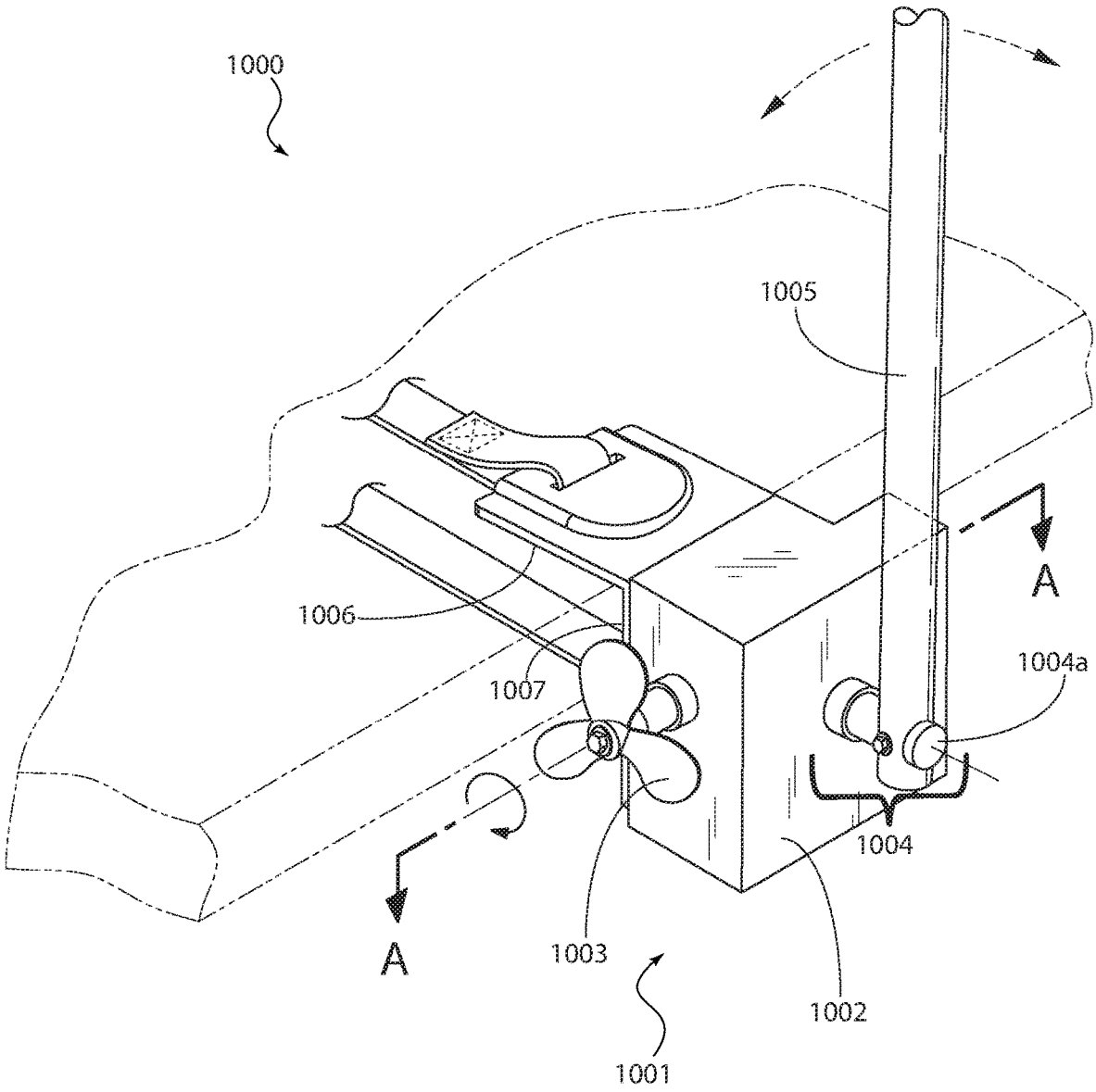
FIG. 10A illustrates a perspective view of an oar assembly that includes a propelling device in accordance with some exemplary embodiments of the present invention.
Figure 10B:
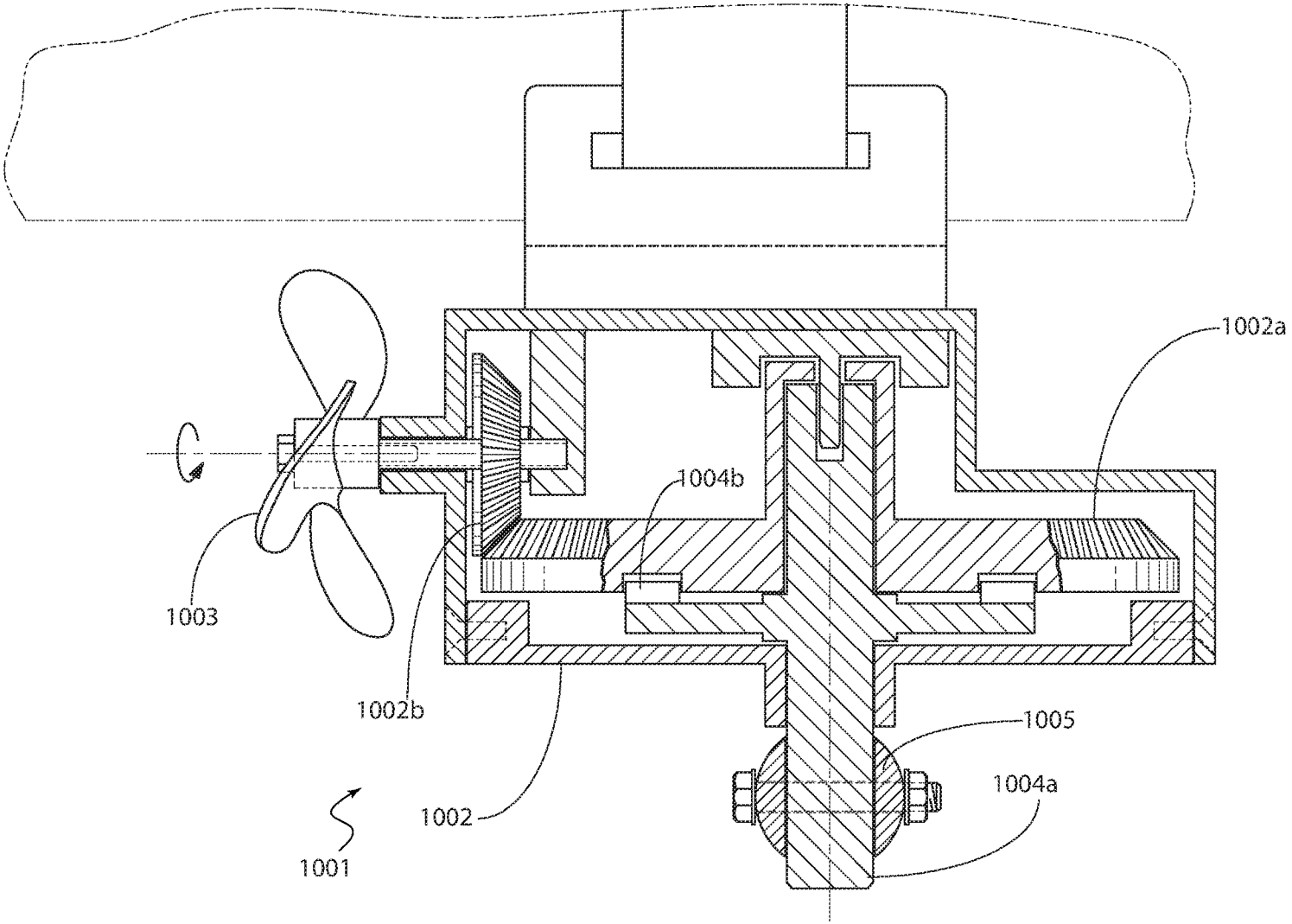
FIG. 10B illustrates a cross-sectional view of an oar assembly that includes a propelling device in accordance with some exemplary embodiments of the present invention.

Now turning to the final set of figures, FIG. 10A illustrates a perspective view of an oar assembly that includes a propelling device in accordance with some exemplary embodiments of the present invention, and FIG. 10B illustrates a cross-sectional view thereof. This set of figures shows an embodiment that may be suitable for all users, including seniors and children, since a propeller may alleviate some of the strenuous exercising that comes with using ores without a propelling device. As will be discussed in more detail below, oar assembly 1000, which comprises of a propelling device 1001, facilitates rowing by eliminating some of the strains in the more laborious strokes required with versions of the present invention that include a pivotable paddle as disclosed above with reference to other figures.

More specifically, these figures depict oar assembly 1000, which comprises of a propelling device 1001 including a gearbox 1002 mechanically coupled to a propeller 1003, and an oar receiving member 1004 including a gear box arm 1004*a* that is mechanically coupled to an oar 1005. In some exemplary embodiments, gearbox 1002 includes one or more gears configured to engage in a single direction upon movement of oar 1005. Accordingly, when a user moves oar back and forth along a length of the board to which assembly 1000 is coupled to, the gears within gearbox 1002 may engage during a thrust stroke but do not engage during an idle stroke. For example and without limiting the scope of the present invention, with reference to the top cross-sectional view along line A-A in FIG. 10A as depicted in FIG. 10B, when oar 1005 is pushed or pulled in a first direction, one or more gearbox arm teeth 1004*b* coupled to gearbox arm 1004*a* may engage with gear 1002*a* of gearbox 1002 such that gear 1002 is also engaged causing propeller 1003 to move in a propelling direction. However, when oar 1005 is respectively pushed or pulled in a second direction opposite to the first direction (typically along a longitudinal axis or length of the board), the one or more gearbox arm teeth 1004*b* coupled to gearbox arm 1004*a* do not engage with gear 1002*a* of gearbox 1002 such that gear 1002 does not move and thus does not engage propeller 1003. This means of propelling the board simulates the use of oars in that there is a thrust stroke and an idle stroke; turning may be achieved by controlling the propeller with alternating strokes from either oar on either side of the board—engaging a propeller one side more than on an opposite side will cause the board to turn.

In some exemplary embodiments, a housing of propelling device 1001 or gearbox 1002 may be coupled to an L-shaped bracket that comprises of perpendicular planar supports including a horizontal planar support 1006 adapted to register with the top surface of the water sports board, and a vertical planar support 1007 adapted to register with the edge of the water sports board.

FIG. 10A shows the similarity between such exemplary L-shaped bracket with those discussed with reference to previous embodiments in the earlier referenced figures. For example, and without limiting the scope of the present invention, propelling device 1001 may be directly coupled to a portion of the vertical planar support 1007—adapted to register with the edge of the water sports board—that is opposite to the side that makes contact with the board, as depicted in FIG. 10A.

The foregoing detailed description has set forth various embodiments of the devices and/or processes by the use of diagrams, flowcharts, and/or examples. Insofar as such diagrams, flowcharts, and/or examples contain one or more functions and/or operations, it will be understood by those within the art that each function and/or operation within such diagrams, flowcharts, or examples may be implemented, individually and/or collectively, by a wide range of variations therein.

Moreover, a person of ordinary skill in the art will recognize that various materials may be used to construct the various components, elements, and parts of an oar assembly in accordance with the present invention, including without limitation, plastics, metals, carbon fiber or graphite fiber materials, or any other materials suitable for submerging in water, and durable enough to withstand being placed in water as is typical with all water sports equipment for all types of water ways.

The subject matter described herein sometimes illustrates different components contained within, or connected with, other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

A paddleboard kit has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A paddleboard kit, comprising:

a pair of oars with pivotable paddles; and an oar support assembly including a pair of board couplers coupled to a strap for securing the oar support assembly and the pair of oars to a water sports board, each of the pair of board couplers comprising:

a board support member having a bracket comprising perpendicular planar supports including a horizontal planar support adapted to register with a top surface of the water sports board, and a vertical planar support adapted to register with an edge of the water sports board; and an oar receiving member swivably coupled to the bracket and configured to receive one of the pair of oars with pivotable paddles.

2. The paddleboard kit of claim 1, wherein:

the bracket of the board support member further comprises a fork end; and the oar receiving member comprises a swivable body including a rotatable base having an aperture for receiving one of the pair of oars with pivotable paddles therein, the oar receiving member configured to facilitate a rotation of the rotatable base about a first axis and a rotation of the swivable body about a second axis that is perpendicular to the first axis.

3. The paddleboard kit of claim 1, wherein each of the pair of oars with pivotable paddles comprises:

a paddle support coupled to a shaft, the paddle support having a paddle stop parallel to the shaft; and a paddle body pivotably coupled to the paddle support with a rod perpendicular to the shaft traversing the paddle support and the paddle body, such that the paddle body has a range of motion about the rod that is limited by the paddle stop.

4. The paddleboard kit of claim 1, wherein each of the pair of oars with pivotable paddles comprises:

a paddle support coupled to a shaft, the paddle support having a paddle stop perpendicular to the shaft;

a hinge coupled to the paddle support along a length of the shaft; and a paddle body comprising paddles swivably connected by the hinge, such that the paddles have a range of motion about the hinge limited by the paddle stop paddle stop.

5. The paddleboard kit of claim 1, wherein a shaft of each of the pair of oar arms includes a removable segment for adjusting a length of the shaft.

6. The paddleboard kit of claim 1, wherein the strap includes an adjustable clasp for adjusting a length of the strap.

7. The paddleboard kit of claim 1, further comprising strap attachment slots on each of the perpendicular planar supports for receiving a portion of the strap therethrough.

8. The paddleboard kit of claim 1, further comprising:

strap attachment slots on each of the perpendicular planar supports; and a second strap, wherein the strap is a first strap that connects respective horizontal planar supports of the oar support assembly, and the second strap connects respective vertical planar supports of the oar support assembly.

9. The paddleboard kit of claim 8, wherein the first strap and the second strap each includes an adjustable clasp for adjusting a length of each strap.

10. The paddleboard kit of claim 1, further comprising the water sports board included with the pair of oars with pivotable paddles and the oar support assembly in a single package.

11. A paddleboard kit, comprising:

a pair of oar arms; and an oar support assembly including a pair of board couplers coupled to a strap for securing the oar support assembly and the pair of oar arms to a water sports board, each of the pair of board couplers comprising:

a board support member having a bracket comprising perpendicular planar supports including a horizontal planar support adapted to register with a top surface of the water sports board, a vertical planar support adapted to register with an edge of the water sports board, and strap attachment slots on each of the perpendicular planar supports for receiving a portion of the strap therethrough; and an oar receiving member swivably coupled to the bracket and configured to receive one of the pair of oar arms.

12. The paddleboard kit of claim 11, further comprising:

a propelling device coupled between the board coupler and the oar receiving member, the propelling device configured to propel the water sports board upon movement of one of the pair of oar arms coupled to the oar receiving member.

13. The paddleboard kit of claim 12, wherein the propelling device comprises:

a gearbox having a gearbox arm mechanically coupled to the oar receiving member; and a propeller mechanically coupled to the gearbox, the propeller configured to actuate upon movement of the oar receiving member.

14. The paddleboard kit of claim 13, wherein the gearbox comprises of a one-directional gearbox such that one or more gears of the gearbox are configured to engage in a single direction upon movement of the oar receiving member.

15. The paddleboard kit of claim 11, wherein:

the bracket of the board support member further comprises a fork end; and the oar receiving member comprises a swivable body including a rotatable base having an aperture for receiving one of the pair of oar arms therein, the oar receiving member configured to facilitate a rotation of the rotatable base about a first axis and a rotation of the swivable body about a second axis that is perpendicular to the first axis.

16. The paddleboard kit of claim 11, further comprising a pair of pivotable paddles detachable from the oar arms, each of the pair of pivotable paddles comprising:

a paddle support coupled to a shaft, the paddle support having a paddle stop parallel to the shaft; and a paddle body pivotably coupled to the paddle support with a rod perpendicular to the shaft traversing the paddle support and the paddle body, such that the paddle body has a range of motion about the rod that is limited by the paddle stop.

17. The paddleboard kit of claim 11, further comprising a pair of pivotable paddles detachable from the oar arms, each of the pair of pivotable paddles comprising:

a paddle support coupled to a shaft, the paddle support having a paddle stop perpendicular to the shaft;

a hinge coupled to the paddle support along a length of the shaft; and a paddle body comprising paddles swivably connected by the hinge, such that the paddles have a range of motion about the hinge limited by the paddle stop paddle stop.

18. The paddleboard kit of claim 11, wherein a shaft of each of the pair of oar arms includes a removable segment for adjusting a length of the shaft.

19. The paddleboard kit of claim 11, wherein the strap includes an adjustable clasp for adjusting a length of the strap.

20. The paddleboard kit of claim 11, further comprising:

a second strap, wherein the strap is a first strap that connects respective horizontal planar supports of the oar support assembly, and the second strap connects respective vertical planar supports of the oar support assembly.

* * * * *